US005115168A

United States Patent [19]

Shoda et al.

[11] Patent Number: 5,115,168

[45] Date of Patent: May 19, 1992

[54] POWER SUPPLY FOR MICROWAVE DISCHARGE LIGHT SOURCE

[75] Inventors: Isao Shoda; Hitoshi Kodama; Kazuo Magome, all of Kamakura; Akihiko Iwata, Amagasaki; Kenji Yoshizawa, Amagasaki; Masakazu Taki, Amagasaki, all of Japan

[73] Assignee: Mitsubishi Denki Kabushiki Kaisha, Tokyo, Japan

[21] Appl. No.: 616,244

[22] Filed: Nov. 20, 1990

Related U.S. Application Data

[62] Division of Ser. No. 329,786, Mar. 17, 1989, Pat. No. 4,988,922.

[30] Foreign Application Priority Data

Jul. 28, 1987 [JP] Japan ..... 62-188256

[51] Int. Cl.[5] ..... H05B 37/02

[52] U.S. Cl. ..... 315/223; 315/39.51; 315/207; 315/283; 331/87; 331/88

[58] Field of Search ..... 315/39, 248, 105, 207, 315/223, 106, 39.51, 283; 331/86, 87, 88

[56] References Cited

U.S. PATENT DOCUMENTS

| | | | |
|---|---|---|---|
| 3,973,165 | 8/1976 | Hester | 331/87 X |
| 4,005,370 | 1/1977 | Kusunoki et al. | 328/270 X |
| 4,076,996 | 2/1978 | Maehara et al. | 315/106 |
| 4,498,029 | 2/1985 | Yoshizawa et al. | 315/111.21 X |
| 4,544,863 | 10/1985 | Hashimoto | 315/223 X |
| 4,585,974 | 4/1986 | Stupp et al. | 315/223 X |
| 4,593,167 | 6/1986 | Nilssen | 331/88 X |
| 4,673,846 | 6/1987 | Yoshizawa et al. | 315/39 X |
| 4,720,658 | 1/1988 | Tsuzurahara | 315/39.51 |
| 4,748,383 | 5/1988 | Houkes | 315/283 X |
| 4,851,629 | 7/1989 | Bessyo et al. | 315/39.51 X |
| 4,885,506 | 12/1989 | Nilssen | 315/39.51 X |

FOREIGN PATENT DOCUMENTS

| | | |
|---|---|---|
| 0202579 | 11/1986 | European Pat. Off. . |
| 2640780 | 3/1977 | Fed. Rep. of Germany . |
| 56-126250 | 10/1981 | Japan . |
| 56-162899 | 12/1981 | Japan . |
| 57-55091 | 4/1982 | Japan . |
| 60-189889 | 9/1985 | Japan . |
| 62-90899 | 4/1987 | Japan . |
| 62-113395 | 5/1987 | Japan . |
| 62-290098 | 12/1987 | Japan . |

*Primary Examiner*—Eugene R. LaRoche
*Assistant Examiner*—Do Hyun Yoo
*Attorney, Agent, or Firm*—Burns, Doane, Swecker & Mathis

[57] ABSTRACT

A power supply circuit for a magnetron adapted to supply microwave energy to an electrodeless discharge bulb is disclosed. The circuit includes a rectifier coupled across a commerical AC voltage source, a filter for smoothing the output of the rectifier, an inverter for converting the DC voltage supplied from the filter into a high frequency AC voltage, a step-up transformer for stepping up the high frequency AC voltage outputted from the inverter, and a rectifier which rectifies the high voltage AC output of the transformer into a unidirectional voltage which is supplied to the magnetron. The inverter switching is controlled by a pulse width modulation control circuit to maintain the magnetron output power at a predetermined level. According to one aspect, an inductance is provided in the circuit which supresses high frquency components in the current flowing through the windings of the transformer; according to another aspect, the inverter switching frequency (expressed in kHz) is set at a value not less than 1500/D, wherein D represents the diameter of the electrodeless bulb expressed in millimeters; according to still another aspect, the peak to the mean value ratio of the magnetron current is limited under 3.75 inclusive.

14 Claims, 14 Drawing Sheets

POWER SUPPLY FOR MICROWAVE DISCHARGE LIGHT SOURCE

This application is a divisional, of application Ser. No. 07/329,786, filed Mar. 17, 1989 U.S. Pat. No. 4,988,922 issued Jan. 29, 1991.

TECHNICAL FIELD

The present invention relates to a microwave generating system including a magnetron and a power supply circuit therefor, which is adapted to supply microwave energy to a microwave discharge light source, including an electrodeless bulb.

BACKGROUND ART

In recent years, microwave discharge light source having an electrodeless bulb disposed in a microwave resonance cavity has been developed and is attracting attention because of its long life. FIG. 1*a* shows one of such microwave discharge light source apparatus disclosed in Japanese Laid-Open Patent Application 56-126250; FIG. 1*b* shows a modification thereof disclosed in Japanese Laid-Open Patent Application 57,-55091. In both apparatuses, a magnetron 1 having an antenna 1*a* is disposed at the end of a waveguide 2 having ventilating holes 2*a* which supplies the microwave generated by the magnetron 1 to a resonance cavity 3 through a microwave supply port 3*a*; the cavity 3 is formed by a paraboloidal wall 3*b* having a light reflecting rotationally symmetric inner surface and a metallic mesh 3*c* forming the front face of the cavity 3, which opaque to microwave but transparent to light. A spherical electrodeless discharge bulb 4 disposed in the cavity 3 and having encapsulated therein a plasma generating medium emits light through the metallic mesh 3*c* covering the front face of the cavity 3, when the microwave is radiated into the bulb 4: at first, the gas enclosed in the bulb 4 undergoes discharge, due to the microwave radiated into the cavity 3; thus, the inner surface of the bulb 4 is heated, and the metal, such as mercury, deposited on the inner surface of the bulb 4 is evaporated into a gas; as a result, the discharge in the bulb 4 goes over to that of the metallic gas, in which light having an emission spectrum peculiar to the kind of the metal is emitted from the discharging metallic gas. The emitted light is reflected by the cavity wall 3*b* and is radiated forward through the front mesh 3*c*. The apparatuses further comprise a fan 5 at the end wall of the housing 6 for cooling the magnetron 1 and the bulb 4.

Microwave discharge light source apparatuses similar to those described above are also disclosed in U.S. Pat. Nos. 4,498,029 and 4,673,846, both issued to Yoshizawa et al. The first of these U.S. Patents teach an apparatus in which the bulb is sufficiently small to act substantially as a point light source; the second teach an apparatus in which the wall surface of the microwave resonance cavity having the electrodeless bulb disposed therein is mostly constituted by a mesh, wherein the wires constituting the mesh are electrically connected each other without any contact resistance.

A conventional power supply circuit for a magnetron is disclosed in Japanese Laid-Open Utility Model Application 56-162899, or in the first of the above mentioned U.S. Patents, according to which a commercial voltage source at 50 to 60 Hz is coupled to a step-up transformer, and the resulting stepped-up high-voltage AC current is rectified by a full-wave rectifier circuit to obtain pulsing unidirectional current which is supplied to the magnetron. As the rectification is effected by a full-wave rectifier circuit, the resulting high voltage rectified current pulsates at 100 to 120 Hz; consequently, the magnetron generates a microwave pulsing at 100 to 120 Hz. Thus, when magnetron 1 is supplied by this conventional circuit, the discharge in the bulb 4 is caused by the microwave pulsing at 100 to 120 Hz.

The disadvantage of this type of conventional power supply circuit is as follows. First, as the commercial AC voltage of relatively low frequency, i.e., 50 to 60 Hz, is directly supplied to the primary winding of the step-up transformer to obtain a high voltage needed to supply the magnetron, the transformer should be provided with a heavy iron core; the weight of the transformer is equal to or greater than 10 kg when the input power to the magnetron is 1.5 kW. Second, as a full-wave rectifier circuit is used to rectify the AC current induced in the secondary winding of the transformer, neither one of the terminals of the secondary winding can be grounded; thus, the over-all size of the transformer should be further increased to ensure an electrical insulation thereof; in addition, extremely high voltage may develop in portions within or outside of the transformer, which diminishes the reliability of the parts thereof. If the rectifier circuit coupled to the secondary winding of the transformer is constituted by a half wave rectifier circuit, one terminal of the secondary winding of the step-up transformer can be grounded to minimize the above-mentioned drawbacks of the conventional power supply circuit. This, however, causes another problem: as the voltage applied to the magnetron 1 is reduced to 0 during the half period of the commercial AC voltage cycle, the generation of the microwave is stopped for about 8 to 10 ms; thus there is the danger that the discharge is extinguished during the same time intervals. Thus, a full-wave rectifier circuit must have been used to rectify the outputs of the step-up transformer.

FIG. 2*a* shows an inverter type power supply circuit for a magnetron taught in Japanese Patent Publication 60-189889, wherein the magnetron 1 is supplied by the circuit as described in what follows. A rectifier circuit 8 is coupled across the lines of a commercial AC voltage source E; a pair of series-connected capacitors Cl and C2 are coupled across the output terminals of the rectifier circuit 8 to obtain a substantially constant voltage DC power. An oscillator circuit 9, which comprises a Zener diode Zn, a capacitor C3, a plurality of resistors, and an amplifier A, is coupled across the capacitor C2 to output a rectangular waveform signal having a frequency substantially higher than that of the commercial AC voltage source E to a control circuit 10 comprising a transistor T1, a diode D1, and a plurality of resistors; the frequency of the rectangular waveform signal of the oscillator circuit 9 is determined by the values of the resistors and the capacitor C3 thereof. The control circuit 10 controls the alternate switching actions of a switching circuit comprising the power transistors 11 and 12 and the controlling transistors 11*a* and 12*a* therefor. Namely, by alternately turning on and off the controlling transistors 11*a* and 12*a*, the circuit 10 alternately turns on and off the power transistors 11 and 12 in response to the output signal of the oscillator circuit 9. Thus, a high frequency rectangular waveform AC current is supplied to the primary winding P of the transformer T through a filter circuit 13. The AC voltage induced in the secondary winding S of the transformer T is rectified by a voltage doubler rectifier circuit consisting of a capacitor C4 and a diode D2, and is supplied therefrom to the magnetron 1.

The inverter type power supply for a magnetron as described above also suffers disadvantages. Namely, as the magnetron 1 constitutes a non-linear load, the output power and current thereof and the inverter current supplied to the step-up transformer become unstable when the voltage level of the voltage source E fluctuates; the over-current resulting therefrom may destroy the power transistors 11 and 12.

FIG. 2*b* shows another inverter type power supply circuit for a magnetron taught in Japanese Laid-Open Patent Application 62-113395, wherein the magnetron 1 is supplied by the circuit as follows. A diode bridge rectifier circuit 8 comprising four diodes Do is coupled across the commercial AC voltage source E; a smoothing filter circuit 9 consisting of a capacitor Co is coupled across the output terminals of the rectifier circuit 8 to output a substantially constant DC voltage therefrom. The switching circuit 10 comprises switching transistors Q1 and Q2 and diodes D1 and D2 for reverse currents coupled across the source and the drain thereof, respectively, the transistors Q1 and Q2 being coupled across the negative output terminal of the filter circuit 9 and the terminals P1 and P2 of the primary winding P of the transformer T, respectively. The positive output terminal of the filter circuit 9 is coupled to the center tap 0 of the primary winding P f the transformer T. The gate terminals g1 and g2 of the transistors Q1 and Q2, respectively, is coupled to the center tap 0 of the primary winding P of the transformer T. The gate terminals g1 and g2 of the transistors Q1 and Q2, respectively, are coupled to the output terminals of a control circuit 11. The voltage doubler rectifier circuit 12 consisting of series-connected capacitor Cl and a diode D3 is coupled across the terminals S1 and S2 of the secondary winding S of the transformer T; the negative output terminal d of the rectifier circuit 12 is coupled to the cathode K of the magnetron 1, which is heated by a filament current supplied thereto from a commercial AC voltage source through an electrically insulating transformer (not shown) and the lines h; the positive output terminal f of the rectifier circuit 12, on the other hand, is coupled to the anode A of the magnetron 1 through a resistor R, the terminals of the resistor R being coupled to the input terminals of the control circuit 11.

The control circuit 11 outputs pulses to the transistors Q1 and Q2 at a varying frequency centered around a fixed frequency, to alternately turn on and off the transistors Q1 and Q2. Thus, the current flows alternately from the center tap 0 to the terminal P1 and to the terminal P2 of the primary winding P of the transformer T to induce an AC voltage in the secondary winding S thereof, which is rectified by the rectifier circuit 12 and supplied therefrom to the magnetron 1. The pulse signals of the control circuit 11 at the fixed frequency are subjected to frequency modulation utilizing a modulating signal having a frequency which is lower than the frequency of the fixed frequency of the output pulse signals, to prevent flickering of the discharge in an electrodeless bulb such as those shown in FIGS. 1*a* and 1*b;* the flickering of the discharge is caused by an acoustic resonance in the bulb due to the ripple or fluctuation of the microwave energy. Further, the circuit 11 varies the length of time during which the transistors Q1 and Q2 are turned on, so that the output power of the magnetron is held constant irrespective of the fluctuation in the voltage source level; this can be effected by detecting the magnetron current by means of the voltage drop across the resistor R, thanks to the substantially constant voltage characteristic of the magnetron 1.

The inverter type power supply circuit for a magnetron described just above is small-sized and is effective to a certain degree to prevent the flickering of the discharge arc of the electrodeless discharge bulb, thanks to the adoption of the high frequency inverter in the circuit The flickering of the discharge arc, however, may persist even in the apparatuses supplied by the circuit, depending on the kind and amount of the material encapsulated in the bulb and on the microwave energy level radiated into the bulb: the flickering of the arc is particularly manifest when a metal halide compound such as sodium iodide is encapsulated in the bulb in addition to mercury and a starter rare gas, or when the microwave energy supplied to the bulb is at a high level. Further disadvantage of the circuit of FIG. 2*b* is that the controlling circuit 11 thereof has a complicated structure, because the pulse signals thereof are subjected to frequency modulation and the length of the turning-on time of the switching is varied to maintain the output power of the magnetron 1 at a constant level.

Power supply circuits for a magnetron utilizing inverters are also disclosed in U.S. Pat. No. 4,593,167 issued to Nilssen and U.S. Pat. No. 3.973,165 issued to Hester. The first of these U.S. patents teach a power supply circuit for a magnetron of a microwave oven including an inverter, wherein the step-up transformer exhibits relatively high leakage between its input and output windings and a capacitor is connected across the step-up transformer's output winding; further, a rectifier and filter means is connected in parallel with the capacitor, and supplies substantially constant DC voltage to the magnetron. The second U.S. patent teach an inclusion of an inverter in a power supply for a magnetron which supplies microwave energy to a microwave oven, etc, wherein the DC current obtained by rectifying a commercial AC voltage of 60 Hz is supplied to the step-up transformer through an inductor, which prevents high frequency currents or voltages to flow into the AC voltage source lines. Further, Japanese Laid-Open Patent Application 62-290098 teaches a microwave discharge light source apparatus including an inverter type power supply circuit for the magnetron, wherein the inverter frequency is set at a few tens kHz, for example, thereby maintaining parameters of the plasma in the bulb at a substantially constant level to prevent the flickering of the discharge in the bulb.

DISCLOSURE OF THE INVENTION

Thus, an object of the present invention is to provide a power supply circuit including a magnetron adapted to supply microwave energy to a microwave discharge light source apparatus including an electrodeless discharge bulb, wherein the circuit is small in size and light in weight; more particularly, an object of the present invention is to reduce the size and weight of the step-up transformer comprised in the circuit.

Another object of the present invention is to provide such power supply circuit including a magnetron which supplies microwave energy that is capable of sustaining stable discharge in the electrodeless bulb of the light source apparatus; namely, it is an object of the present invention to provide a power supply circuit which does not cause flickering in the discharge in the bulb and which is capable of sustaining the discharge in the bulb without any fear of extinguishment.

According to the present invention, a power supply circuit system including a magnetron adapted to supply microwave energy to a microwave discharge light source apparatus including an electrodeless discharge bulb is provided, which comprises: rectifier and filter means, adapted to be coupled to a commercial AC voltage source, for supplying a substantially constant DC voltage; inverter means, supplied by the rectifier and filter means, for converting the DC voltage into a high frequency AC voltage having a waveform of alternating pulses; pulse width modulation means for modulating the pulse width of the pulses of the AC voltage outputted by the inverter means; step-up transformer having an input or primary winding supplied by the output of the inverter means, the output or secondary winding thereof outputting a stepped-up high frequency AC voltage, the voltage level of which is substantially higher than that of the commercial voltage source; second rectifier means, coupled to the secondary winding of the step-up transformer, for rectifying the output voltage of the secondary winding of the step-up transformer into a DC voltage; and a magnetron supplied with the voltage outputted by the second rectifier means.

According to one aspect of the present invention, the circuit system further comprises inductance means operatively coupled to the step-up transformer to suppress the rapid changes in the level of the current flowing through the primary or the secondary winding of the step-up transformer. In other words, inductance means is provided which reduces high frequency components in the current flowing through the primary or the secondary winding of the step-up transformer. Thus, stable operation of the inverter is ensured.

According to a second aspect of the present invention, the inverter switching frequency, i.e., the frequency of the AC voltage outputted therefrom, expressed in Kilohertz is set at a value which is not less than 1500/D, wherein D is the diameter, expressed in millimeters, of the electrodeless discharge bulb supplied by the magnetron of the circuit system. Thus, a stable discharge without flickering can be maintained in the electrodeless bulb without any fear of extinguishment.

According to a third aspect of the present invention, the circuit system further comprises high frequency component reducing means for reducing the high frequency components of the magnetron current, thereby limiting the ratio $i_{max}/i_o$ of the peak to the means value of the magnetron current under 3.75 inclusive:

$$i_{max} / i_o < 3.75$$

Thus, the flickering in the discharge can be effectively suppressed.

BRIEF DESCRIPTION OF THE DRAWINGS

Further details of the invention will become more clear in the following description of the best modes for carrying out the present invention, taken in conjunction wit the accompanying drawings, in which.

BEST MODES FOR CARRYING OUT THE INVENTION

First Mode: Fundamental Structure and Operation

Figure 3A:
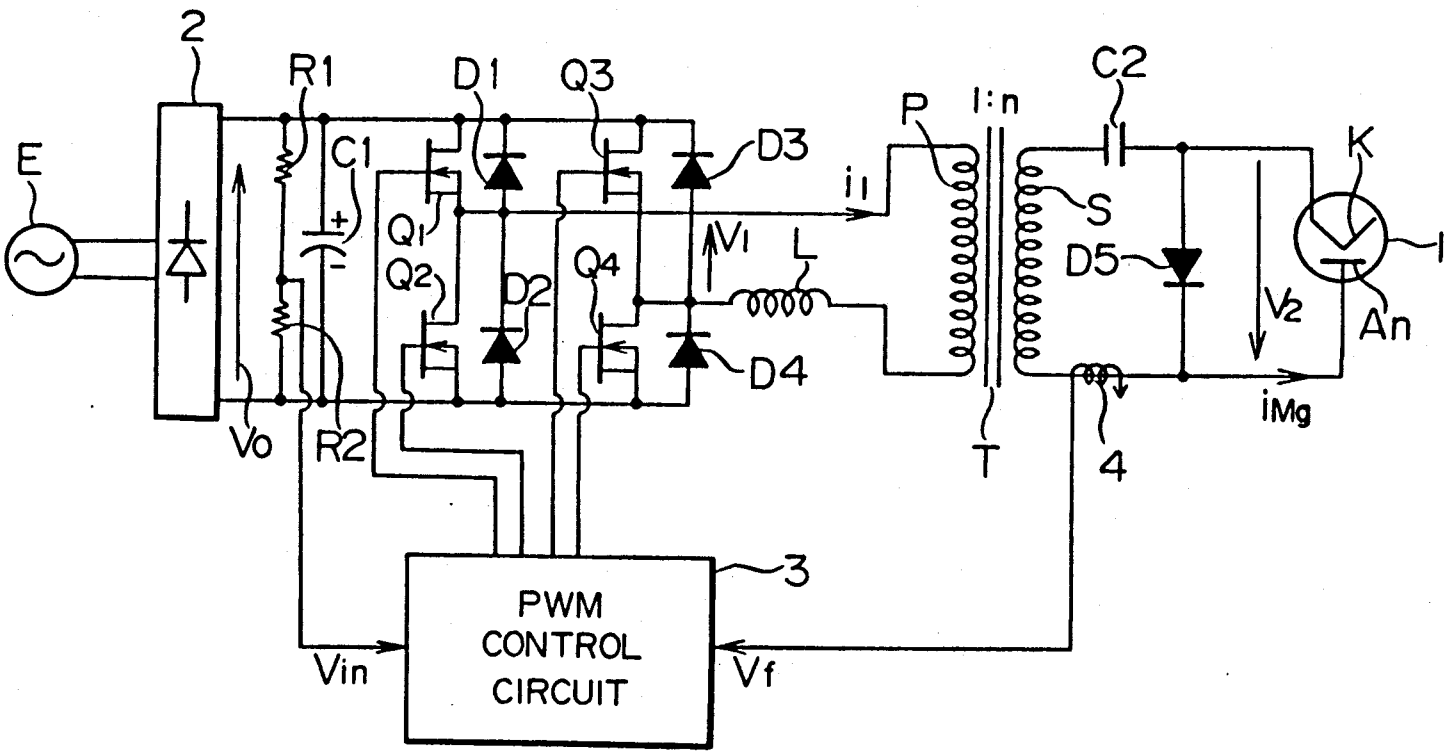
FIG. 3*a* is a diagram showing a power supply circuit according to a first embodiment of the present invention.
Figure 3B:
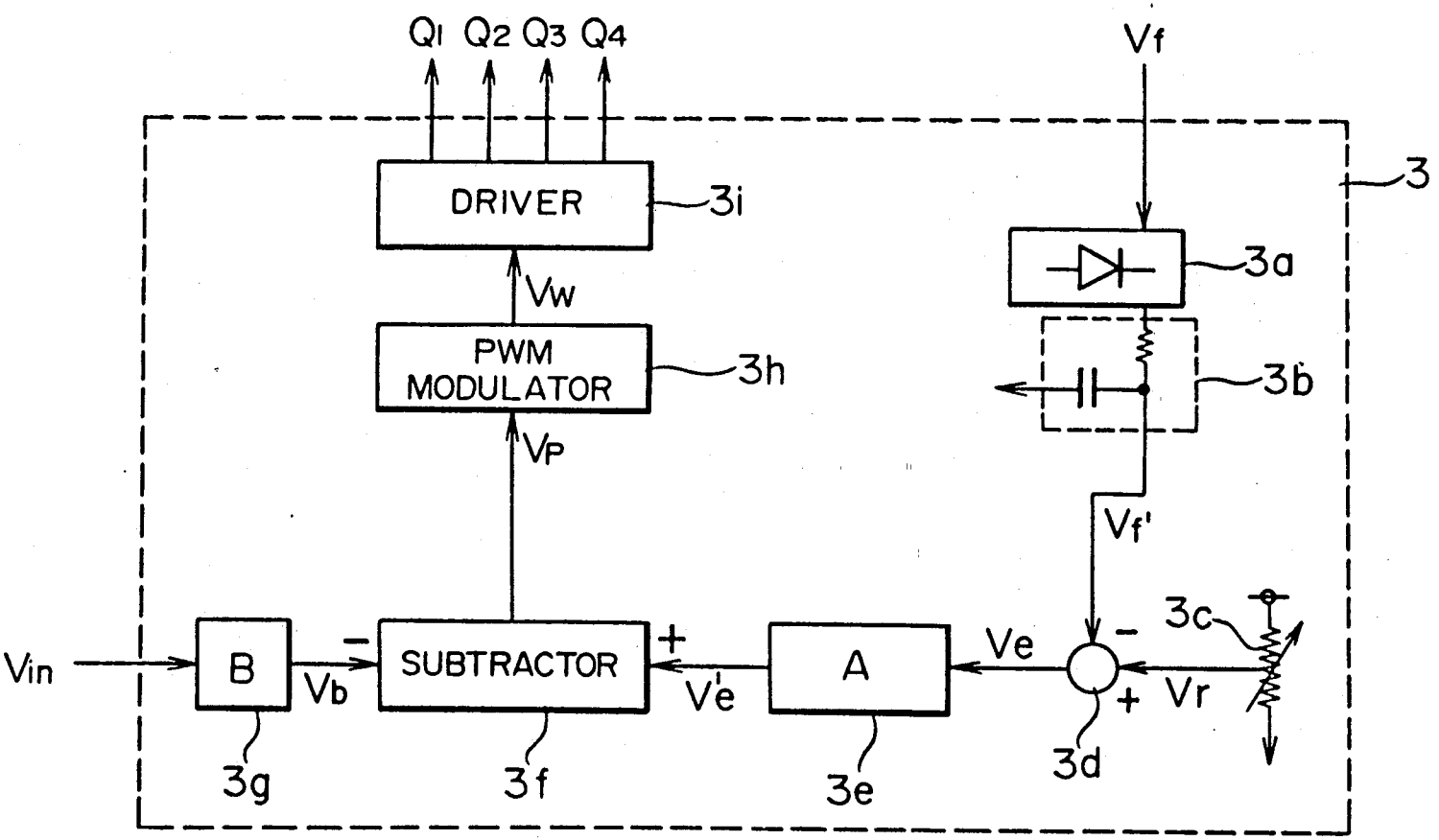
FIG. 3*b* is a block diagram showing the details of the PWM control circuit in the power supply circuit of FIG. 3*a;*

Referring now to FIGS. 3*a* and 3*b* of the drawings, a first embodiment according to the present invention is described.

The power supply circuit for the magnetron 1 comprises a diode bridge full-wave rectifier circuit 2, the input terminals of which are coupled across a commercially available AC voltage source E, typically on the order of 100 to 220 volts RMS at 50 to 60 Hz. A voltage divider consisting of a pair of resistors R1 and R2 connected in series is coupled across the output terminals of the rectifier circuit 2. Further, a capacitor Cl constituting a smoothing filter circuit is coupled across the output terminals of the rectifier circuit 2 to supply a substantially constant DC voltage therefrom. The input terminals of the inverter switching circuit comprising four MOSFETs (metal oxide semiconductor field effect transistors) Q1 through Q4 connected in bridge circuit relationship are coupled across the output terminals of the filter circuit, the capacitor Cl; the output terminals of the switching circuit is coupled across the primary or input winding P of the step-up transformer T having a step-up ratio of 1 to n, a reactor L being inserted in series with the primary winding P. The inverter switching circuit further comprises four diodes D1 through D4 for reverse currents, which are coupled across the source and the drain terminal of the MOSFETs Q1 through Q4, respectively, the gate terminals of the MOSFETs being coupled to the output terminals of the PWM (pulse width modulation) control circuit 3. Further, a voltage doubler half-wave rectifier circuit consisting of a capacitor C2 and a diode D5 connected in series is coupled across the secondary or output winding S of the transformer T; the output terminals of the rectifier circuit, i.e., the terminals across the diode D5, are coupled across the cathode K and the anode An of the magnetron 1 to supply a pulsating DC current $i_{Mg}$ thereto.

The output terminals of a current detector 4 for detecting the current flowing through the secondary winding S of the transformer T are coupled to the PWM control circuit 3 to output a voltage Vf corresponding to the current flowing through the secondary winding S. As, shown in FIG. 3*b*, the control circuit 3 comprises a half-wave rectifier 3*a* rectifying the output Vf of the current detector 4, a smoothing filter 3*b* coupled to the output of the rectifier 3*a* to output a smoothed voltage Vf' corresponding to the mean value of the voltage Vf; the error detector or subtractor 3*d* is coupled to the outputs of the filter 3*b* and a variable resistor 3*c* outputting a pre-set reference voltage Vr, and outputs the difference: between the reference Vr and the mean voltage Vf'. The amplifier 3*e* amplifies the error or the difference Ve by a factor A, and outputs an amplified error signal:

$$Ve' = A \cdot Ve.$$

Further, for the purpose of feeding the value of the voltage Vo forward to the control circuit 3, the output terminal of the voltage divider consisting of the resistors R1 and R2 i.e., the terminal at the intermediate position between the two resistors R1 and R2, which outputs a voltage Vin corresponding to the output voltage Vo of the smoothing filter capacitor Cl, is coupled to another amplifier 3*g* which amplifies the signal Vin by a factor of B to output a signal:

$$Vb = B \cdot Vin$$

The subtractor 3*f* coupled to the outputs of the amplifiers 3*e* and 3*g* outputs the difference $$Vp = Ve' - Vb$$

to the modulator 3*h*. The modulator 3*h* outputs pulses Vw at a predetermined fixed frequency which is substantially higher than that of the AC voltage source E, the width of the pulses Vw being modulated, i.e., varied with respect to a predetermined fixed pulse width, in proportion to the value of the signal Vp. The driver circuit 3*i* coupled to the output of the modulator 3*h* outputs gate signals to the MOSFETs Q1 through Q4 of the inverter switching circuit in response to the signal Vw, and alternately turns on and off the MOSFETs Q1 and Q4 and the MOSFETs Q2 and Q3. Thus, high frequency AC current, flows through the primary winding P of the transformer T to induce an AC voltage in the secondary winding S thereof, which is rectified and supplied to the magnetron 1 through the rectifier circuit consisting of the capacitor C2 and the diode D5.

More explicit description of the operation of the circuit of FIGS. 3*a* and 3*b* is as follows.

Figure 4:
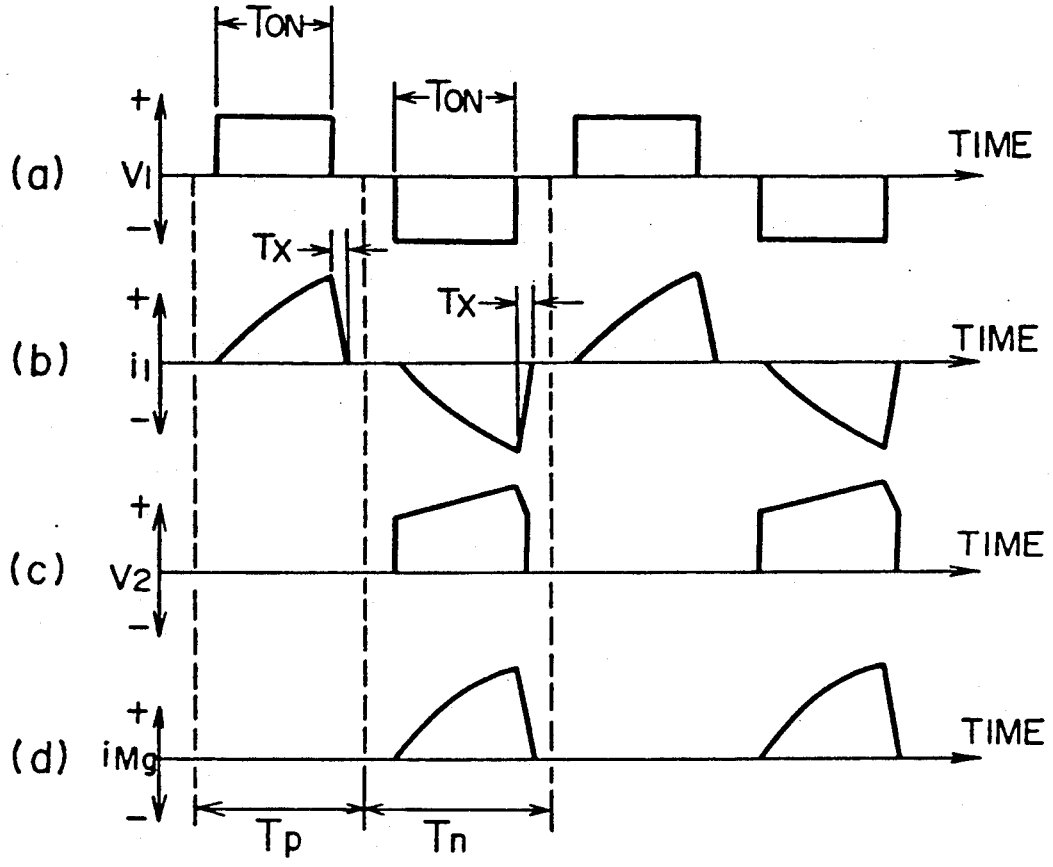
FIG. 4 shows waveform of voltages and currents in the circuit of FIG. 3*a;*

First, the operation during a positive half-cycle Tp of the inverter switching cycle is described, referring to FIG. 4 as well as FIGS. 3*a* and 3*b*. When the driver 3*i* of the control circuit 3 turns on the MOSFETs Q1 and Q4, while the MOSFETs Q2 and Q3 are turned off, the output voltage V1 of the inverter switching circuit rises substantially to a level equal to the output voltage Vo of the filtering capacitor Cl and is kept thereat during the time interval in which the MOSFETs Q1 and Q4 are tuned on; thus, the output voltage V1 of the inverter switching circuit has a square-shaped waveform, as shown in FIG. 4(*a*). The duration TON of the positive voltage V1 i.e., the pulse width thereof corresponds to the pulse width of the gate signal outputted from the driver 3*i* and that of the signal Vw outputted from the PWM modulator 3*h* of the control circuit 3; the height of the pulse V1 is substantially equal to the output voltage Vo of the filtering capacitor Cl. Due to the inductance of the reactor L connected in series with the primary winding P of the transformer T, the current $i_l$ flowing through the primary winding P in the direction shown by the arrow in FIG. 3*a* increases gradually from zero to a maximum during the time in which the voltage V1 is maintained at the level, as shown in FIG. 4(*b*); after the MOSFETs Q1 and Q4 are turned off and the voltage V1 returns to zero level, the current $i_l$ in the primary winding P of the transformer persists during a short time Tx, due to the existance of the inductance of the reactor L connected in series with the primary winding P. During this short time period Tx, the current $i_l$ flows through the diodes D2 and D3 to charge the capacitor Cl. The current induced in the secondary winding S of the transformer during this positive half-cycle Tp of the inverter has a polarity corresponding to the conducting direction of the diode D5; thus, no currents $i_{Mg}$ flows through the magnetron 1 and the voltage V2 across the cathode K and the anode An of the magnetron 1 is equal to zero, as shown in FIG. 4 (*c*) and (*d*), the capacitor C2 being charged by the current induced in the secondary winding S during the positive half-cycle Tp.

Figure 5:
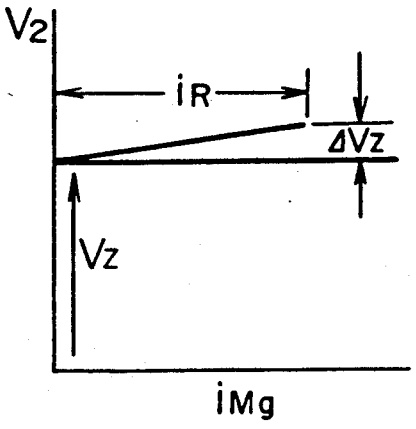
FIG. 5 shows the current-voltage characteristic of a magnetron.

The operation of the power supply circuit during the negative half-cycle Tn of the inverter is as follows. During the negative half-cycle Tn, the MOSFETs Q2 and Q3 are turned on by the control circuit 3; thus, the polarities of the output voltage V1 of the inverter switching circuit and the current $i_l$ flowing through the primary winding P of the transformer T are reversed, as shown in FIG. 4 (*a*) and (*b*). Except for this, the operation of the circuit electrically coupled to the primary winding P of the transformer T during the negative half cycle Tn is similar to the operation thereof in the positive half-cycle Tp. However, the voltage induced in the secondary winding S by the current $i_l$ flowing through the primary winding P in the direction opposite to that shown by the arrow in FIG. 3*a*, the induced voltage in the secondary winding S is superposed on the voltage developed across the capacitor C2 which is already charged in the preceding positive half-cycle Tp; thus, as shown in FIG. 4(*c*), the voltage V2 applied across the magnetron 1 jumps to the voltage level to which the capacitor C2 has been charged in the previous half-cycle Tp, when the MOSFETs Q2 and Q3 are turned on and the output voltage V1 goes down from zero to a negative level as shown in FIG. 4(*a*). After this, the voltage V2 applied across the magnetron 1 increases gradually during the time $T_{ON}$ in which the MOSFETs Q2 and Q3 are turned on and the output voltage V1 of the switching circuit is kept at the negative level, due to the gradual decrease of the voltage developed across the reactor L during the same time period $T_{ON}$. The current $i_{Mg}$ flowing through the magnetron 1, on the other hand, increases gradually from Zero to a maximum, as shown in FIG. 4(*d*) during the time $T_{ON}$, due to the current-voltage characteristic of the magnetron 1. Namely, as shown in FIG. 5, the voltage V2 across the magnetron 1 plotted along the ordinate is at a finite voltage level Vz when the magnetron current $i_{Mg}$ plotted along the abscissa begins to flow through the magnetron 1. The magnetron voltage V2 increases linearly from this cut-off voltage Vz to a maximum Vz+ΔVz, as the magnetron current $i_{Mg}$ increases from zero to $i_R$, exhibiting the equivalent series resistance $$r_{Mg}=\Delta Vz / i_R$$

in the linear relationship range. After the MOSFETs Q2 and Q3 are turned off and the output voltage V1 of the inverter switching circuit returns to zero level, the current $i_l$ in the primary winding P of the transformer T persists in the short length of time Tx due to the reactor L, during which the magnetron voltage V2 and the magnetron current $i_{Mg}$ decreases and returns to the zero level at the end thereof, as shown in FIG. 4 (*c*) and (*d*).

The output power of the magnetron 1 is held at a constant level by the modulation of the pulse width $T_{ON}$ of the gate signals applied to the MOSFETS Q1 through Q4 from the control circuit 3. Detailed explanation thereof is as follows.

The output power $P_{OUT}$ of the magnetron 1 is approximately given by the product of the mean value of the magnetron current $i_{Mg}$ shown in FIG. 4(*d*) and the magnetron voltage V2, because the rise ΔVz in the voltage V2 is small compared to the magnitude of the cut-off voltage Vz, as shown in FIG. 5, when the magnetron 1 is operated within the rated current and voltage range. Thus, $P_{OUT}$ is approximated as follows:

$$P_{OUT} \simeq f \cdot \frac{V_z/n}{(\alpha^2+\omega^2)L} \cdot (2V_o - V_z/n) \cdot \frac{1-a}{1-a\cdot b}(1+b), \quad (1)$$

wherein, the meanings of the symbols are as follows:

f: the switching frequency of the inverter, or the frequency of the pulses of the voltage V2 and the current $i_{Mg}$l;

α: $(r_{Mg} / n^2+Ro) / 2L$;

ωL $\sqrt{(1/LC)-\alpha}$;

$\alpha_o$: Ro / 2L;

$\omega_o$: $\sqrt{(1/Lc)-\alpha_o^2}$

Ro: the interior resistance of the voltage source;

n: step-up ratio of the transformer T;

L: inductance of the reactor L;

C: the conversion value of the capacitance of the capacitor C4 in a equivalent circuit in which the capacitor C4 is forming part of the circuit electrically coupled to the primary winding P; $T_{ON}$: the length of time during which the MOSFETs Q1 through Q4 are turned on, which is equal to the pulse width of the output signals of the control circuit 3, or the pulse width of the voltage V1, as shown in FIG. 4(*a*);

the values of a and b in the equation (1) being given as follows:

$$a = l^{-\alpha_o T_{ON}} \cdot \frac{1}{\omega_o} \cdot (-\alpha_o \sin \omega_o T_{ON} - \omega_o \cos \omega_o T_{ON});$$

$$b = l^{-\alpha_o T_{ON}} \cdot \frac{1}{\omega} \cdot (-\alpha \sin \omega T_{ON} - \omega \cos \omega T_{ON}).$$

Figure 6:
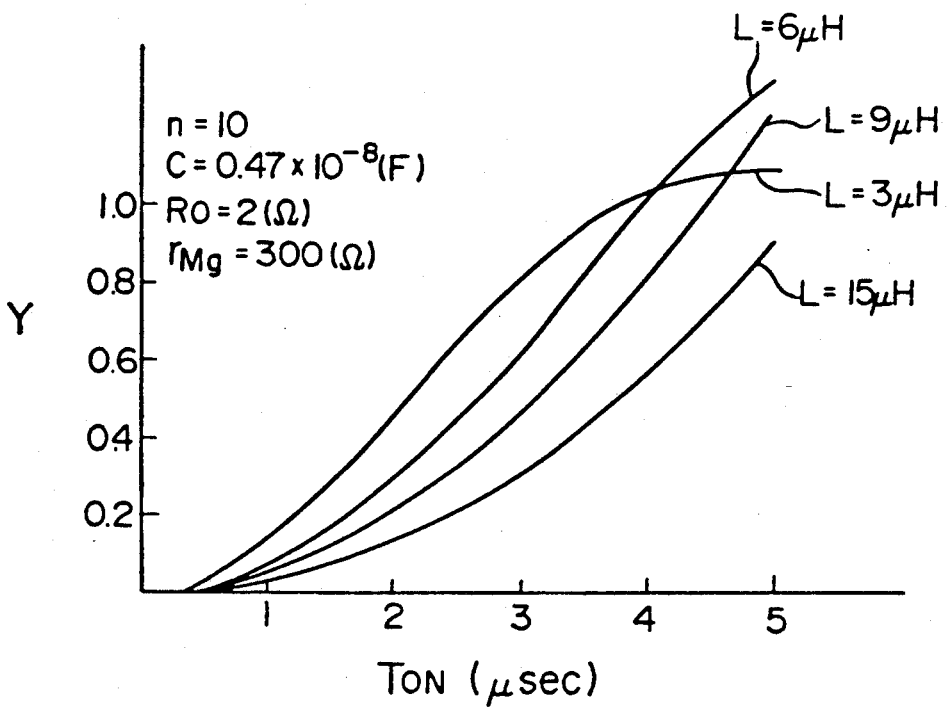
FIG. 6 shows the relationships between the pulse width of magnitude corresponding to the output power of the magnetron.

Thus, FIG. 6 shows the relationship between the value $$Y = \frac{1+a}{1-a\cdot b}(1+b)$$

appearing in the right hand side of equation (1) and $T_{ON}$, in the case where n=10,

C=0.47×10⁻⁸ F,

Ro=2Ω, $r_{Mg}$=300Ω.

As seen from the figure, the vaiue Y increases as the pulse width $T_{ON}$ increases; provided that the frequency f of the inverter is about 100 kHz and the operating range of the pulse width $T_{ON}$ is approximately from 4 to 5 microseconds, the value Y is approximately in linear relationship with the pulse width $T_{ON}$. Thus, under these conditions, the increase in the output power $P_{OUT}$ given by equation (1) above is approximately proportional to the increase in the pulse width $T_{ON}$. On the other hand, the mean voltage signal Vf', which is obtained from the voltage Vf corresponding to the magnetron current $i_{Mg}$ by rectifying and smoothing it by the rectifier 3*a* and the smoothing filter 3*b* as shown in FIG. 3*b*, is proportional to the magnetron output power $P_{OUT}$. Thus, when the magnetron output power $P_{OUT}$ decreases, the error signal Ve, the increase of which corresponds to the decrease in the magnetron output power $P_{OUT}$, increases, because the decrease in the output power $P_{OUT}$ increases, the mean voltage signal Vf' increases, thereby decreasing the error signal Ve. Thus, the pulse with $T_{ON}$ also decreases to decrease the output power $P_{OUT}$. Therefore, the magnetron output power $P_{OUT}$ is maintained at a constant level determined by the setting of the variable resistor 3*c*.

Further, the peak or maximum value $i_{Mg}$ max during the stable operation of the magnetron 1 is given, when $\omega T_{ON}>Z$, by:

$$i_{Mg\,max} = \frac{1+a}{1-ab} \cdot l^{-az/\omega} \cdot \sin z \cdot \frac{(2V_o - V_Z/n)}{n\omega L} \quad (2)$$

and, when $T_{ON} \leqq Z$, by:

$$i_{Mg\,max} = \frac{1+a}{1-ab} \cdot l^{-\alpha T_{ON}} \cdot \sin \omega T_{ON} \cdot \frac{(2V_o - V_Z/N)}{n\omega L},$$

wherein $$Z=\tan-1(\omega/\alpha). \ldots \quad (2)$$

Figure 7:
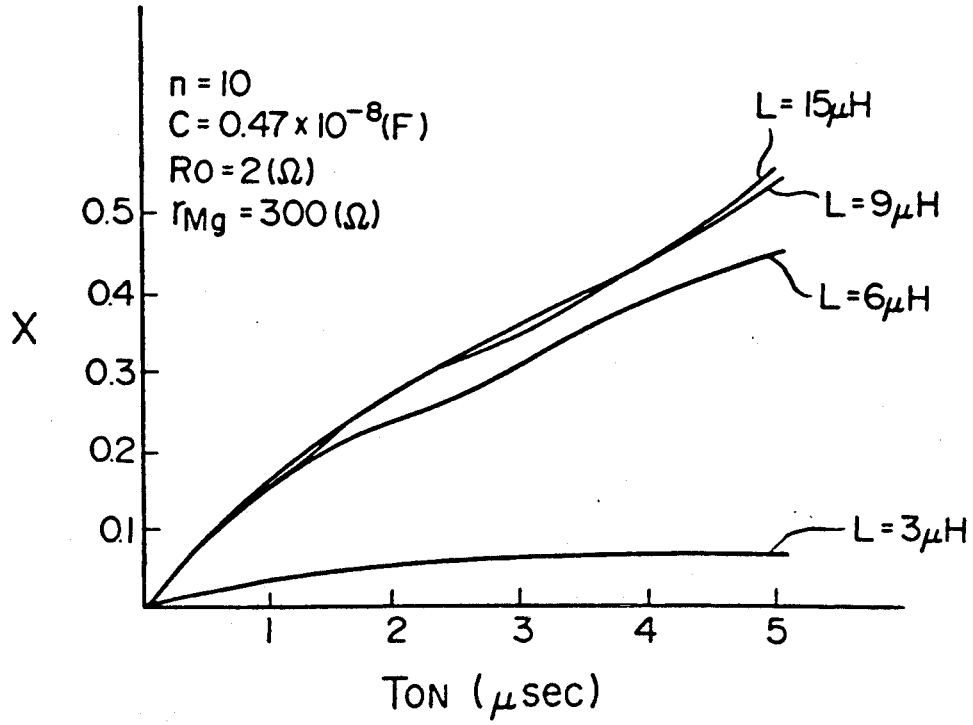
FIG. 7 shows the relationships between the pulse width of the gate signals supplied to the inverter switching circuit and a magnitude corresponding to the peak magnetron current.

FIG. 7 shows the relationship between the value $$X = i_{Mg\,max} / \frac{(2V_o - V_Z/n)}{n\omega L}$$

corresponding to the variable factors in the expression (2) and (2)' and the pulse width $T_{ON}$, in the case where $n=10$, $C=0.47\times10^{-8}$ F, $Ro=2\Omega$, $r_{Mg}=300\ \Omega$.

As seen from the figure, the value X is proportional to the pulse width $T_{ON}$ when the inductance L of the reactor L is large enough; for example, in the case where the frequency f of the inverter is around 100 kHz and the pulse width $T_{ON}$ is limited within the range from about 4 to 5 microseconds, the magnetron peak current $i_{Mg\,max}$ can be represented by a linear equation if the value of L is selected at 8 miceohenries at which the value of X is approximately proportional, to the pulse width $T_{ON}$; namely, $i_{Mg\,max}$ is approximated by:

$$i_{Mg\,max} = K\cdot(2Vo - V2/n)\cdot T_{ON}, \ldots \quad (3)$$

wherein K is the proportionality constant determined by the relationship between X and $T_{ON}$. The output voltage Vo of the filtering capacitor Cl appearing in the right hand side of expression (3) above is subject to variation due to the variation in the AC voltage source E:

$$Vo = V_{DC} + \Delta V, \ldots \quad (4)$$

wherein $V_{DC}$ represents the pure DC, i.e., constant, component of the voltage Vo and $\Delta V$ represents the AC component, i.e., variation, of the voltage Vo. In order to maintain the peak current $i_{Mg}$ max given by the approximate equation (3) at a constant level irrespective of the variation $\Delta V$ in the voltage Vo, $T_{ON}$ should be varied to satisfy the following equation:

$$T_{ON} = K1/(2V_o - V_Z/n) \ldots \quad (5)$$

wherein K1 represents an arbitrary proportionality constant. By substituting the right hand side of equation (4) into the right hand side of equation (5) and expanding the right hand side of the equation (5) into Taylor series, i.e., into an infinite sum of the powers of $\Delta V$, wherein the infinitesimal terms of degrees equal to or greater than 2 are neglected, the pulse width $T_{ON}$ is approximately expressed as follows:

$$T_{ON} = K2 - K3 \ldots \quad (6)$$

wherein K2 and K3 are constants determined by the values of K1, Vo, $V_{DC}$, and n. On the other hand, the modulating signal Vp outputted from the subtractor 3*f* to the PWM modulator 3*h* is given by:

$$Vp = Ve' - Vin\ B.$$

wherein Ve' is constant in a stable operation and Vin is proportional to the voltage $V_o = V_{DC} + \Delta V$. Thus, the pulse width $T_{ON}$ of the signal Vw outputted from the modulator 3*h*, or that of the gate signals outputted from the driver 3*i*, can be expressed as follows:

$$T_{ON} = K4 - K5\cdot\Delta V, \ldots \quad (7)$$

wherein K4 is a constant determined by the magnitude of the amplified error signal Ve' and the constant voltage component $V_{DC}$ of the voltage Vo, and K5 is a constant determined by the voltage signal Vin and the amplifying factor B of the amplifier 3*g*. Therefore, by selecting the values of the constants K4 and K5 in equation (7) in such a way that they agree with the values of the constants K2 and K3 in equation (6), respectively, the peak current $i_{Mg}$ max of the magnetron 1 can be maintained at a constant level irrespective of the variation $\Delta V$ in the smoothed DC voltage Vo outputted from the filtering capacitor Cl. In this manner, the magnetron peak current $i_{Mg\,max}$ is held substantially constant even when the AC line voltage source E fluctuates. In other words, the inverter current flowing through the MOSFETs Q1 through Q4 is stabilized, thereby eliminating the danger of failures thereof.

Second and Third Mode: Simplified Inverter Switching Circuits

Figure 8:
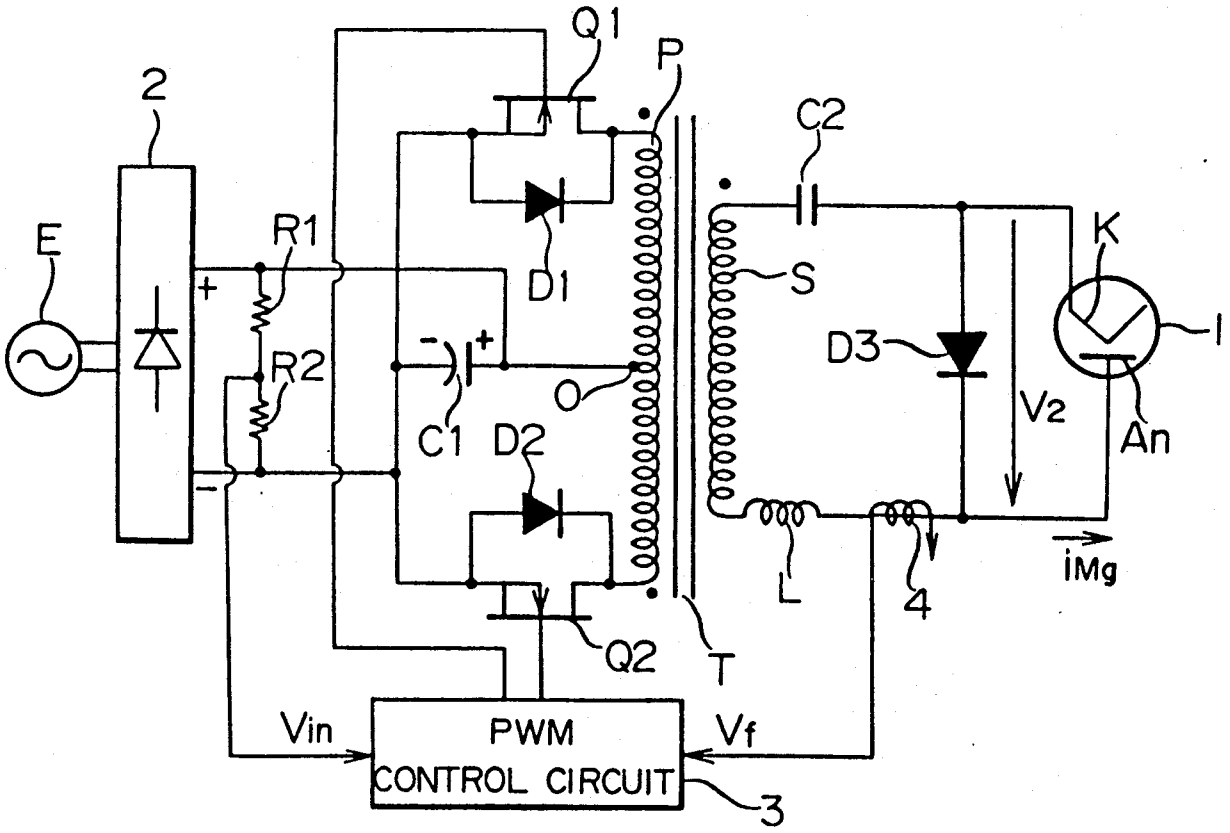
FIGS. 8 and 9 are diagrams showing power supply circuits for a magnetron according to the second and the third embodiment, respectively, of the present invention.
Figure 9:
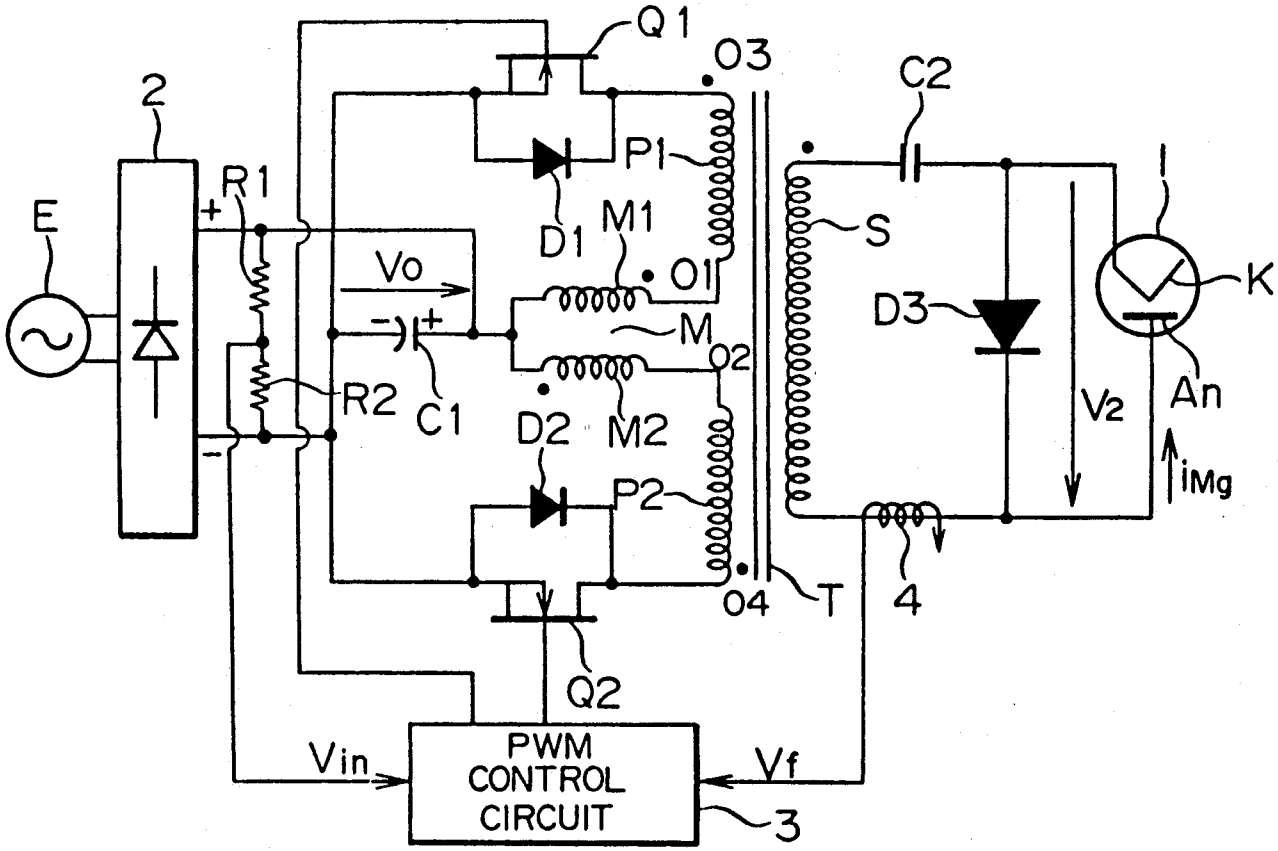

Referring now to FIGS. 8 and 9 of the drawings, a second and a third embodiment according to the present invention having a push-pull type inverter switching circuit are described.

FIGS. 8 and 9 show a second and a third embodiment according to the present invention, respectively, both of which have a structure and operation similar to that of the first embodiment, except for the inverter switching circuit and the position of the reactor. Thus, a full-wave diode bridge rectifier circuit 2 is coupled across the commercial AC voltage source E, the output terminals of the rectifier circuit 2 being coupled across the series connected resistors R1 and R2 constituting a voltage divider and across the capacitor Cl constituting a smoothing filter. The inverter switching circuit, however, consists of a pair of MOSFETs Q1 and Q2, and diodes D1 and D2 coupled across the source and the drain terminal thereof for reverse currents. In the case of the second embodiment shown in FIG. 8, the source and the drain terminal of the MOSFETs Q1 and Q2 are coupled across the negative terminal of the capacitor Cl and the terminals of the primary winding P of the step-up transformer T, respectively, the positive output terminal of the capacitor Cl being coupled to the center tap 0 of the primary winding P of the transformer T. Thus, in this second embodiment, the reactor L having a function corresponding to that of the reactor L of the first embodiment is inserted in series with the secondary winding S of the transformer T, the capacitor C2 and the diode D3 being coupled in series with the secondary winding S and the reactor L to form a rectifier circuit corresponding to the rectifier circuit consisting of the capacitor C2 and the diode D5, as in the case of the first embodiment. In the case of the third embodiment shown in FIG. 9, the primary winding of the transformer T is divided into two portions Pl and P2; a mutual inductance M having a pair of magnetically coupled coils Ml and M2 is coupled across the terminals 01 and 02 without dot marks in the figure, the mutual inductance M effecting a function corresponding to that of the reactor L of the first embodiment. Thus, the MOSFETs Q1 and Q2 are coupled across the negative terminal of the capacitor Cl and the dotted terminals 03 and 04 of the windings Pl and P2, respectively; the positive terminal of the capacitor Cl is coupled to the terminal between the two coils Ml and M2 of the mutual inductance M., The circuit coupled to the secondary winding S of this third embodiment is similar to that of the first embodiment.

In both second and third embodiment, the voltage divider consisting of the series connected resistors R1 and R2 outputs a voltage Vin corresponding to the output voltage Vo of the capacitor Cl to the PWM control circuit 3; the current detector 4 detects the current flowing through the secondary winding S of the transformer T and output a voltage Vf corresponding thereto to the control circuit 3. The control circuit 3, which has a structure and an operation similar to those of the control circuit 3 of the first embodiment, outputs gate signals alternately to the MOSFETs Q1 and Q2, and alternately turns them on and off, modulating the pulse width thereof. Thus, in the positive half-cycle in which the MOSFET Q1 is turned on and the MOSFET Q2 is turned off, the induced voltage in the secondary winding S of the transformer T has a polarity agreeing with that of the diode D3; consequently, the induced current in the secondary winding S charges the capacitor C2 during the positive half-cycle. In the negative half-cycle, the MOSFET Q2 is turned on, while the MOSFET Q1 is turned off; thus, the polarity of the induced voltage in the secondary winding S is reversed, and is applied across the magnetron 1 together with the voltage developed across the capacitor C2. The resulting voltage V2 causing the current $i_{Mg}$ to flow from the anode An to the cathode K of the Magnetron 1.

Fourth Mode: Preferred Inverter Frequency

Figure 10:
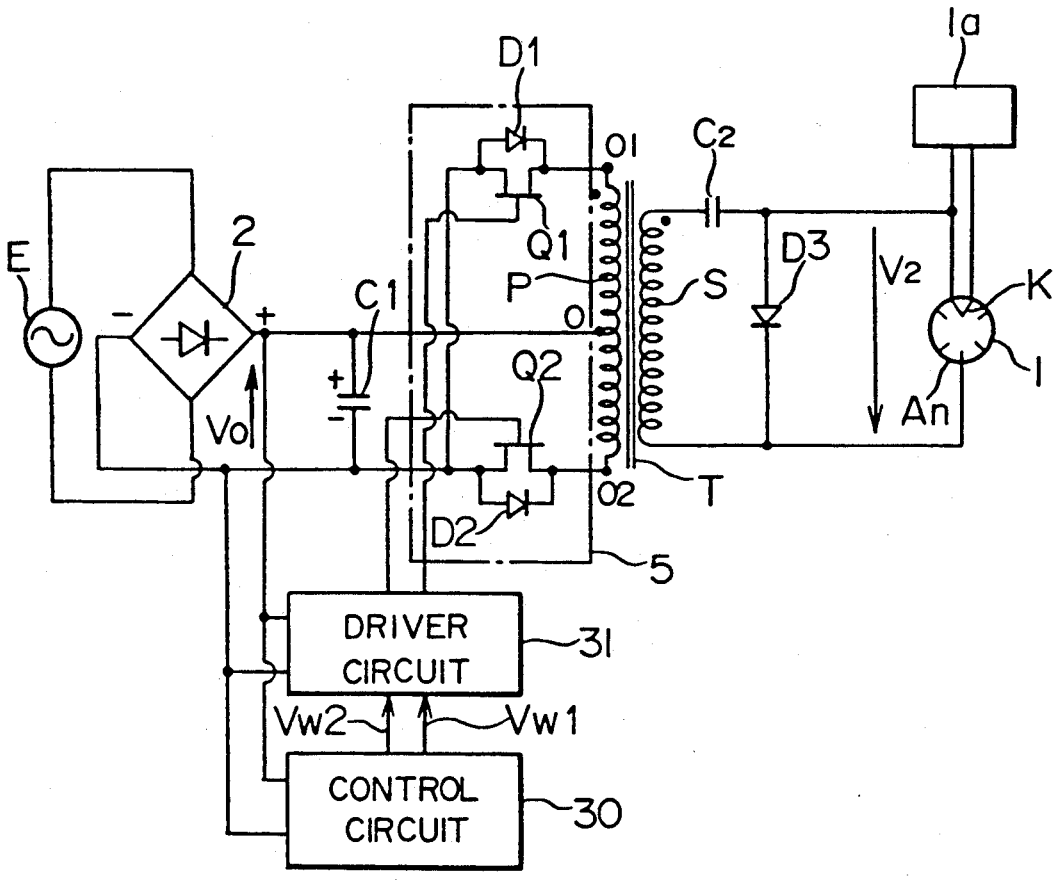
FIG. 10 is a diagram showing a power supply circuit for a magnetron according to the fourth embodiment of the present invention.

Referring now to FIG. 10 of the drawings, a fourth embodiment according to the present invention is described.

The power supply circuit shown in FIG. 10 has a structure similar to that of the second embodiment. Thus, the input terminals of the diode bridge full-wave rectifier circuit 2 are coupled across the output terminals of the commercial AC voltage source E; the output terminals of the rectifier circuit 2 are coupled across the capacitor Cl constituting the smoothing filter circuit. The inverter switching circuit 5 comprises a pair of MOSFETs Q1 and Q2 and diodes D1 and D2 coupled thereacross in reversed polarity. The MOSFETs Q1 and Q2 are coupled across the negative terminal of the capacitor C1 and the terminals 01 and 02 of the primary winding P of the step-up transformer T; the positive terminals of the capacitor C1 is coupled to the center tap 0 of the primary winding P of the transformer T. The voltage doubler half-wave rectifier circuit consisting of a capacitor C2 and a diode D3 connected in series is coupled across the secondary windings S of the transformer T, to supply pulsing DC voltage V2 to ,the magnetron 1 provided with a cathode K and an anode An. The filament voltage source 1*a* for the magnetron 1 is explicity shown in FIG. 10.

However, the fourth embodiment is simplified compared with the second or the third embodiment in certain respects. Namely, no reactor L or mutual inductance M is provided in the circuit. Further, no current detector is provided for detecting the current flowing through the secondary winding S of the transformer T, and the voltage Vo developed across the capacitor C1 is directly supplied to the control circuit 30 and the driver circuit 31.

The control circuit 30 and the driver circuit 31 together correspond to the control circuit 3 of the first through the third embodiment. The control circuit 30 may primarily be constituted by TL-494, an IC for switching regulator source, produced by TI company, for example, and outputs Vw1 and Vw2 alternately to the driver circuit 31; the pulse width of these pulses Vw1 and Vw2 can be varied in response to the voltage Vo supplied thereto. The driver circuit 31 outputs gate signals alternately to the MOSFETs Q1 and Q2 in response to the pulses Vw1 and Vw2 to turn them alternately on and off.

Figure 11:
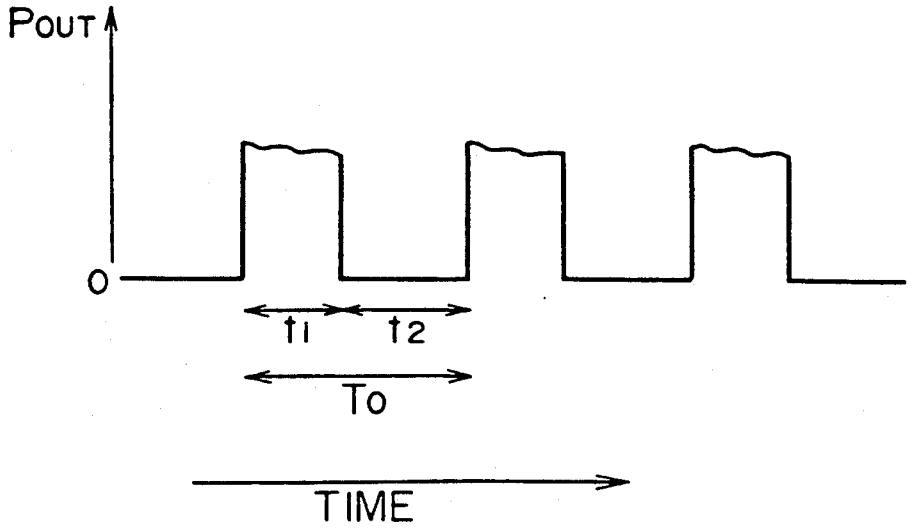
FIG. 11 shows a waveforms of the magnetron output power in the circuit of FIG. 10.

Thus, current alternately flows through the upper and the lower half of the primary winding P from the center tap 0. Consequently, an AC voltage is induced in the secondary winding S of the transformer T which is stepped up by a factor equal to the ratio of the number of turns of the secondary winding S to the number of turns of the primary winding P between the center tap 0 and the terminal 01 or 02 of the transformer T. This AC voltage induced in the secondary winding S is converted into a unidirectional pulsing current by the voltage doubler half-wave rectifier circuit consisting of the capacitor C2 and the diode D3, and is applied therefrom across the magnetron 1; thus, the magnetron is driven by a pulsating current. Consequently, the microwave generated by the magnetron 1 pulsates. FIG. 11 shows the change of the output power $P_{OUT}$ of the microwave generated to time plotted along the abscissa.

The reason why the output power $P_{OUT}$ of the magnetron 1 takes the waveform as shown in FIG. 11 is as follows. In the half-cycle of the switching circuit 5 in which the MOSFET Q2 is turned on, the induced voltage in the secondary winding S has a polarity which agrees with the forward direction of the diode D3. Thus, in this half-cycle, the capacitor C2 is charged by the induced current flowing through the diode D3 and the secondary winding S; no voltage is applied across the magnetron 1. In the succeeding half-cycle in which the MOSFET Q1 is turned on while the MOSFET Q2 is turned off, a voltage having a reversed polarity with respect to the diode D3 is induced in the secondary winding S of the transformer T. Thus, the diode D3 is turned off, and the sum of the voltages induced in the secondary winding S and developed across the capacitor C2, which is charged in the previous half-cycle, is applied across the magnetron 1. In FIG. 11, t1 corresponds to the time in which the MOSFET Q1 is turned on, to drive the magnetron 1 by the sum of the induced voltage in the secondary winding S and the voltage developed across the capacitor C2; t2 represents the time in which the MOSFET Q1 is turned off. Thus, the waveform of the microwave output power of the magnetron 1 consists of a train of pulses having a pulse width t1 and recurring at the period $To=t1+t2$, as shown in FIG. 11.

Figure 1A:
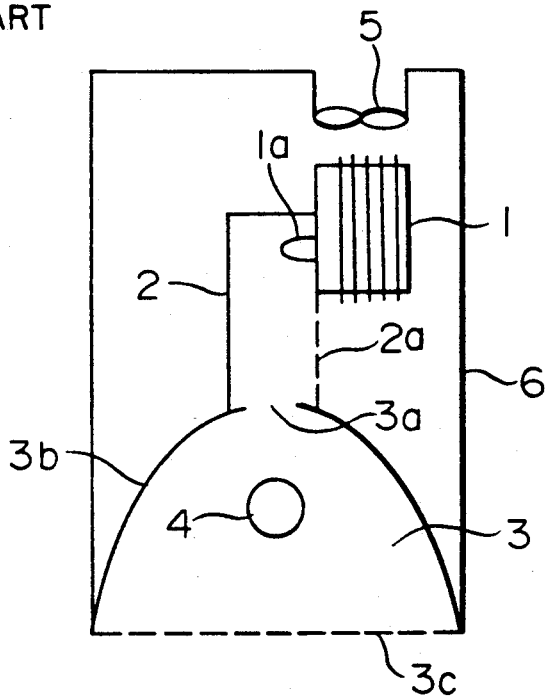
FIG. 1a PRIOR ART
FIGS. 1*a* and 1*b* are schematic sectional views of conventional microwave discharge light source apparatuses.
Figure 1B:
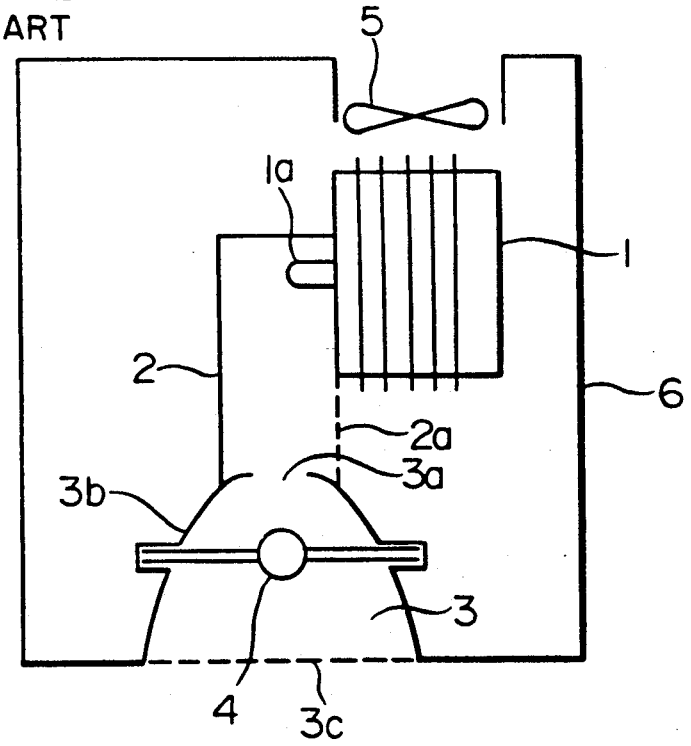
FIG. 1b PRIOR ART

The magnetron 1 is disposed in a microwave discharge light source apparatus, such as those shown in FIGS. 1*a* and 1*b*, which comprise a spherical electrodeless bulb. Then, the inverter switching frequency f, i.e. the frequency $f=1/To$ of the pulses of the microwave output power $P_{OUT}$ of the magnetron 1 expressed in kHz, is preferred to be not less than the magnitude 1500/D; namely; it is preferred that $$f \geqq 1500/D, \ldots \quad (8)$$

wherein

D=(the diameter of the electrodeless bulb expressed in millimeters).

The reason therefor is as follows.

An experiment has been conducted utilizing a microwave discharge light source apparatus shown in FIG. 1*a*, wherein the bulb 4 has a diameter of 30 mm, 100 mg of mercury being encapsulated therein as an light emitting substance. When the magnetron input power is set at 1.5 kW and the inverter switching frequency f is varied in the range of from about 10 to 20 kHz, the discharge in the bulb become unstable in intervals of substantial widths . within this frequency range.

This unstability in the discharge is inferred to be due to an acoustic resonance phenomenon similar to that caused by sound waves in the bulb having electrodes, which is clarified in Shomeigakkaishi (Illumination Society Review) vol. 67 No. 2, pp. 55 through 61. However, in the case of a discharge bulb having electrodes, the discharge therein is an arc discharge caused across the two electrodes, the discharging region generally forming a line across the electrodes. In contrast thereto, the bulb which is utilized in the light source apparatus according to the present invention is electrodeless; the discharge therein is maintained by the microwave energy entering thereinto through the wall thereof: when the bulb has a spherical shape as in the apparatus of FIG. 1*a*, the discharge therein is also spherical. Thus, the state of the discharge caused in the electrodeless bulb by a microwave according to the present invention is completely different from that of the discharge bulb having electrodes; consequently, the acoustic resonance phenomenon of the electrodeless bulb must also differ from that of the bulb having electrodes. More explicitly, it is known that the acoustic resonance phenomenon depends on the velocity of the sound wave in the discharge medium gas and on the dimension and the shape of the discharge bulb; the velocity of the sound wave varies with the temperature and the pressure of the gas through which it is propagated. Thus, as described above, due to the difference in the states of the discharge in the electrodeless bulb and the bulb with electrodes, the temperatures and the temperature distributions of the gas, or the distributions of the velocity of the sound waves in these two types of bulbs, are different from each other.

In spite of these differences, certain conclusions may be drawn from the experiments conducted by the inventors. Namely, in an experiment utilizing the apparatus of FIG. la having a spherical electrodeless bulb 30 mm across (D=30 mm), wherein the inverter switching frequency f was varied to test the stability of the discharge in the bulb in varying frequency, it has been observed as follows: when the frequency f is less than or equal to 50 kHz, the intervals of frequency f in which the discharge is unstable occupy considerable proportions; when the frequency f is greater than 50 kHz, however, the widths of these intervals shrinks rapidly as the frequency f is increased. Thus, under the above condition, it can be concluded that the stable discharge can be maintained in the electrodeless bulb if the discharge in the bulb is caused by the microwave generated by a magnetron driven at a switching frequency not less than 50 kHz. From this particular example, general formula for the preferred value of the inverter switching frequency f can be obtained. Namely, the frequency f at which an acoustic resonance phenomenon takes place is proportional to the sound wave velocity C in the discharging gas and inversely proportional to the diameter D of the discharge bulb:

$$f \propto C / D.$$

The sound wave velocity C in the gas, however, varies little where the mercury in the electrodeless bulb attains a relatively high pressure, i.e. 1 atmosphere, in operation. Thus, the resonating frequency is inversely proportional to the diameter D of the bulb. In the above experiment, it has been decided that the resonance is substantially reduced when the frequency f is not less than 50 kHz at D=30 mm. Thus, it can be generally concluded that the acoustic resonance causing unstability in the discharge can be substantially reduced if the frequency f satisfies the following inequality:

$$f\,(\text{kHz}) \geqq 1500 / D, \ldots \quad (8)$$

wherein D represents the inner diameter of the bulb in millimeters.

Further, if the frequency f satisfies equality (8) above, there is no danger that the discharge in the bulb is extinguished in the time intervals t2 between the pulses of the microwave output power shown in FIG. 11, as explained in what follows:

In the power supply circuit of FIG. 10, a half-wave voltage doubler rectifier circuit consisting of a capacitor C2 and a diode D3 is used to rectify the voltage induced in the secondary winding S of the transformer T. Thus, as shown in FIG. 11, the microwave output power $P_{OUT}$ is reduced to zero in the time intervals t2 between the time intervals t1 in which the MOSFET Q1 is turned on. The duration of the time intervals t2, however, does not exceed 1 millisecond, provided that the frequency f is not less than 1 kHz, even if the pulse width t1 is decreased in PWM control thereof. On the other hand, the so-called after-glow of the discharge, during which the discharge is maintained after the energy supply thereto ceases, is not less than about 1 milliseconds, provided that the plasma generating medium in the bulb consists of substances usually utilized in a discharge bulb, i.e., a rare gas, or a combination of rare gas and mercury or other metal. Thus, if the length of the time intervals t2 in which no microwave energy is supplied to the bulb does not exceed 1 millisecond, the discharge in the bulb is maintaining through the time interval t2 because, after the supply of the microwave energy carried by a pulse thereof ceases, the discharge in the bulb is maintained by the after-glow until the succeeding pulse of microwave energy is supplied thereto. By the way, if the frequency f satisfies inequality (8) above, the diameter D of the bulb must be as great as 1500 mm to reduce the frequency f to 1 kHz at which the length of the time intervals t2 can not exceed 1 milliseconds. However, the diameter D of the bulb does not exceed 100 mm in practical electrodeless discharge light source apparatus. Thus, if the frequency f satisfies inequality (8), the length of time intervals t2 during which the microwave energy supply ceases does not exceed 1 millisecond in a practical electrodeless discharge bulb; consequently, there is no danger that the discharge is extinguished between the microwave energy supply pulses.

Fifth Mode: Preferred Ratio of the Peak to the Mean Magnetron Current

Figure 12:
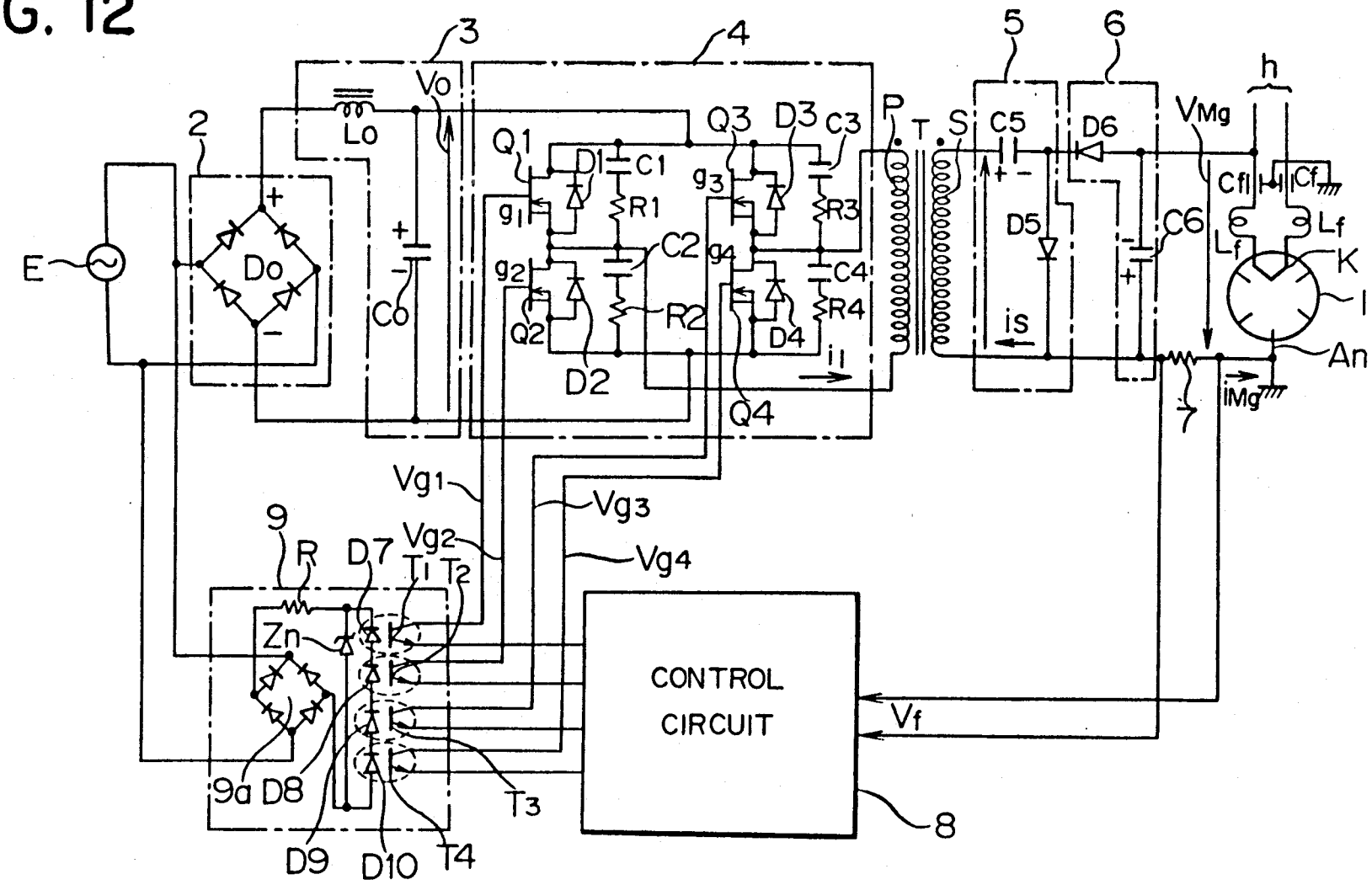
FIG. 12 is a diagram showing a power supply circuit for a magnetron according to a fifth embodiment of the present invention.

Referring now to FIG. 12 of the drawings, a fifth embodiment according to the present invention is described.

The fifth embodiment shown in FIG. 12 has a structure and an operation similar to those of the first embodiment shown in FIGS. 3*a* and 3*b*. Thus, the input terminals of a diode bridge full-wave rectifier circuit 2 consisting of four diodes Do connected in bridge circuit are coupled across a commercial AC voltage source E; a smoothing filter circuit 3 consisting of a choke coil Lo and a smoothing capacitor Co connected in series is coupled across the output terminals of the rectifier circuit 2. The output terminals of the filter circuit 3 are coupled to the input terminals of the inverter switching circuit 4 comprising four MOSFETs Q1 through Q4 connected in bridge circuit relationship; the switching circuit 4 further comprises four diodes D1 through D4 coupled across the source and the drain of the MOSFETs Q1 through Q4 to allow currents in reverse direction, respectively, and a series connection of a capacitor and a resistors C1 and R1 through C4 and R4 coupled across each one of the MOSFETs Q1 through Q4, in parallel with the diodes D1 through D4, respectively. The output terminals of the switching circuit 4 are coupled across the primary winding P of the step-up transformer T. Further, a half-wave rectifier circuit 5 consisting of a capacitor C5 and a diode D5 connected in series is coupled across the secondary winding S of the transformer T; a capacitor-diode circuit 6 is coupled across the diode D5 of the rectifier circuit to reduce high frequency components of the output of the rectifier circuit 5, the capacitor-diode circuit 6 consisting of a capacitor C6 and a diode D6 connected in series. The diode D6 has a forward direction that agrees with the direction of the magnetron current $i_{Mg}$ and suppresses the current in reverse direction therethrough; the capacitor C6 is coupled across the cathode K and the anode An of the magnetron 1 to reduce high frequency components of the current flowing through the magnetron 1. The magnetron 1 is provided with a filament (or heater) voltage supply lines h having noise-filtering capacitors Cf and inductors Lf.

The current detector 7 inserted between the anode An of the magnetron 1 and the positive terminal of the capacitor C6 detects the current $i_{Mg}$ flowing through the magnetron 1, and outputs a voltage Vf corresponding thereto to the control circuit 8. The control circuit 8 has a structure similar to that of the control circuit 3 of the first embodiment shown in FIG. 3*b*, and outputs gate signals Vg1 through Vg4 to the gate terminals g1 through g4 of the MOSFETs Q1 through Q4, respectively, of the inverter switching circuit 4, through an operation interruption circuit 9. The operation interruption circuit 9 comprises: a diode bridge full-wave rectifier circuit 9*a* having input terminals coupled across the AC voltage source E, a Zener diode Zn coupled across the output terminals of the rectifier circuit 9*a* through a resistor R; four series-connected diodes D7 through D10 in parallel circuit with the Zener Zn; and four transistors T1 through T4. Thus, the operation interruption circuit 9 detects the zero phases of the commercial AC voltage source E, and suppress the gate signals Vgl through Vg4 in the neighborhoods of the zero phases of the AC voltage E to interrupt the switching operation of the inverter switching circuit 4 in the same time intervals; thus, the circuit 9 excepts the neighborhoods of the zero phases of the AC voltage E as the operation interrupting periods of the magnetron 1.

The operation of this fifth embodiment shown in FIG. 12 is as follows.

When the rectifier circuit 2 is electrically coupled to the voltage source E through a switch, etc., the AC voltage E is rectified by the rectifier circuit 2 into a pulsating DC voltage; this pulsating DC voltage outputted by rectifier circuit 2 is smoothed into a substantially constant voltage by the filter circuit 3 and outputted therefrom to the switching circuit 4. The control circuit 8 alternately outputs gate pulse signals Vgl and Vg4 and gate pulse signals Vg2 and Vg3 at a predetermined frequency, e.g., at 100 kHz, the pulse width of these gate signals Vgl through Vg4 being modulated to maintain the output power of the magnetron 1 at a predetermined level. Thus, the MOSFETs Q1 and Q4 and the MOSFETs Q2 and Q3 are alternately turned on and off; as a result, the current $i_l$ flowing through the primary winding P of the transformer T changes its direction at the switching frequency of the MOSFETs Q1 through Q4, thereby inducing a square waveform AC voltage of the same frequency in the secondary winding S of the transformer T. The voltage doubler half-wave rectifier circuit 5 coupled across the secondary winding S outputs a pulse-shaped voltage in each half-cycle of the switching circuit 4 in which the MOSFETs Q1 and Q4 are returned on, the magnitude of the voltage outputted by the rectifier circuit 5 being substantially two times as great as the voltage induced in the secondary winding S. This pulsating voltage outputted in said half-cycles of the inverter switching circuit 4 by the rectifier circuit 5 is applied across the capacitor C6 through the diode D6; when this voltage outputted from the rectifier circuit 5 charges the capacitor C6 to the operating (or cut-off) voltage of the magnetron 1, the magnetron driving current $i_{Mg}$ begins to flow through the magnetron 1. Thus, microwave is generated by the magnetron 1, and is supplied to an electrodeless bulb (not shown) to cause a discharge and luminescence therein.

The operation interruption circuit 9, as described above, suppresses the gate signals Vgl through Vg4 during the operation interruption intervals in the neighborhood of the zero phases of the AC voltage source E, typically at 50 to 60 Hz, and stops the operation of the magnetron 1 in these operation interruption intervals. In this embodiment, the length of the operation interruption intervals is set at about 0.5 milliseconds. The purpose of establishing these operation interruption intervals of about 0.5 milliseconds in each half-cycle of the AC voltage source E is as follows: the magnetron 1 may fall into an abnormal operation, such as an abnormal oscillation; if this happens, the magnetron 1 does not recover the normal stable operation by itself; thus, it is desirable to establish certain time intervals in which the operation of the magnetron 1 is stopped.

Figure 13:
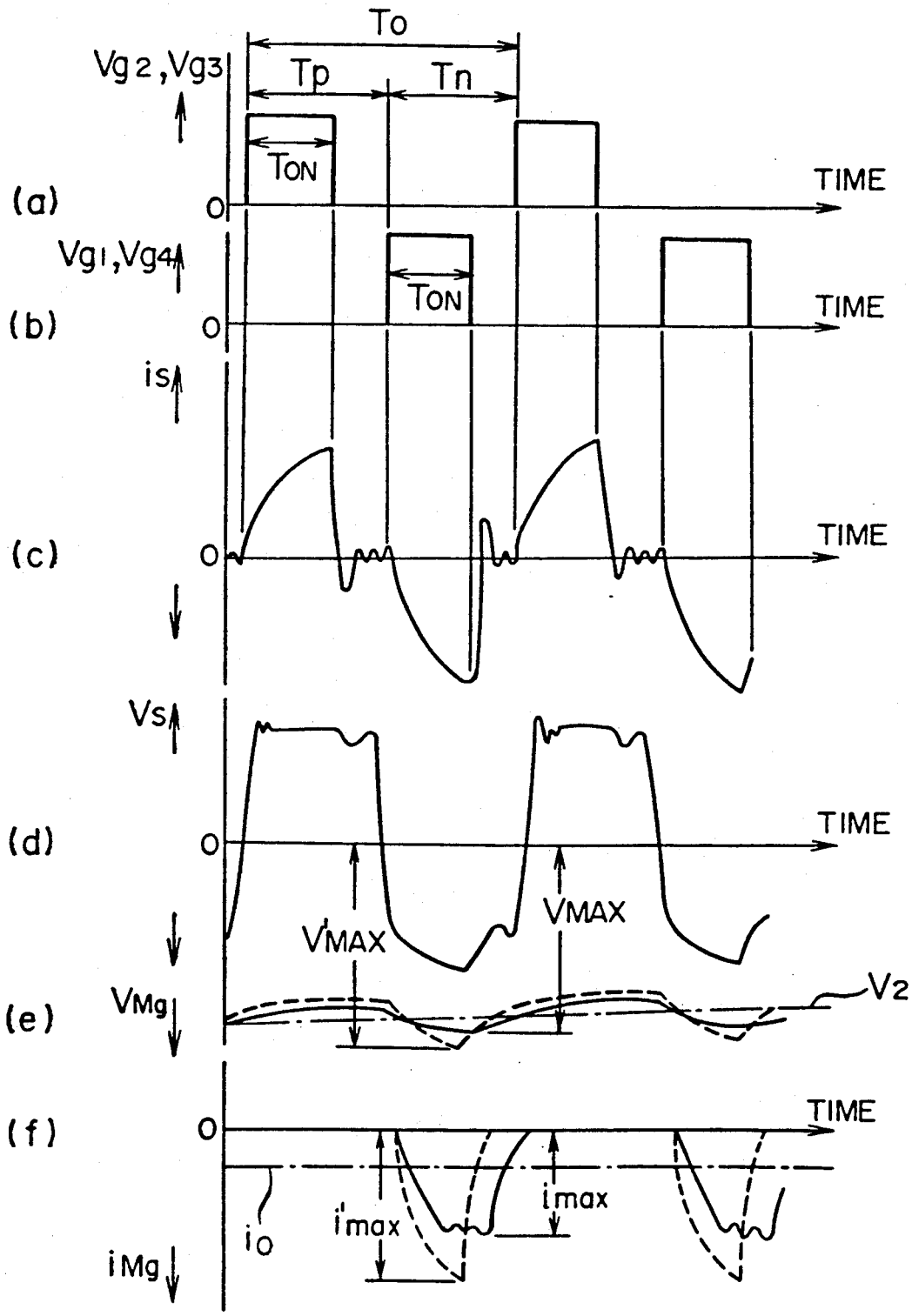
FIG. 13 shows waveforms of currents and voltages in the circuit of FIG. 12.

Referring now to FIG. 13, the operation of the circuit of FIG. 12 is explained more explicity.

The gate signals Vgl through Vg4 have waveforms as shown in FIG. 13 (*a*) and (*b*); the pulses Vg2 and Vg3 are outputted by the control circuit 8 in the half-cycle Tp to turn on the MOSFETs Q2 and Q3; the pulses Vgl and Vg4 are outputted by the control circuit 8 in the half-cycle Tn to turn on the MOSFETs Q1 and Q4. The pulse width $T_{ON}$ of these pulses Vgl through Vg4 are modulated in PWM (pulse width modulation) control by the control circuit 8 to maintain the mean output power of the magnetron 1 substantially at a predetermined level. The frequency f of these pulses Vgl through Vg4, typically about 100 kHz, which is referred to as the inverter switching frequency, is equal to the reciprocal 1/To of the period To of these pulse signals Vgl through Vg4. When the inverter switching frequency f is set at 100 kHz, the pulse width $T_{ON}$ is modulated in a range of from about 3 microseconds to about 4 microseconds.

The operation of the circuit in the half-cycle Tp shown in FIG. 13 is as follows. When the MOSFETs Q2 and Q3 are turned on by the pulses Vg2 and Vg3 in the half-cycle Tp, the current $i_l$ in the primary winding P of the transformer T flows in the direction opposite to that shown by the arrow in FIG. 12. Thus, the voltage Vs induced in the secondary winding S of the transformer T has a polarity shown by the arrow in FIG. 12. The induced voltage Vs rises rapidly substantially to the level n Vo determined by the step-up ratio n of the transformer T and the voltage Vo supplied by the filter circuit 3, as shown in FIG. 13(*d*). The current $i_S$, however, rises gradually from substantial zero to a maximum during the time $T_{ON}$ in which the MOSFETs Q2 and Q3 are turned on, due, for example, to leakage inductance, i.e., self-inductances of the primary and the secondary winding P and S, of the transformer T, as shown in FIG. 13(*c*). In the same time period $T_{ON}$ in the half-cycle Tp, this induced current $i_S$ in the secondary winding S rapidly returns to substantial zero as shown in FIG. 13 (*c*). The voltage Vs across the secondary winding S, however, is kept substantially at the level n·Vo to which the capacitor C5 has been charged during the time interval $T_{ON}$, as shown in FIG. 13 (*d*).

Figure 2A:
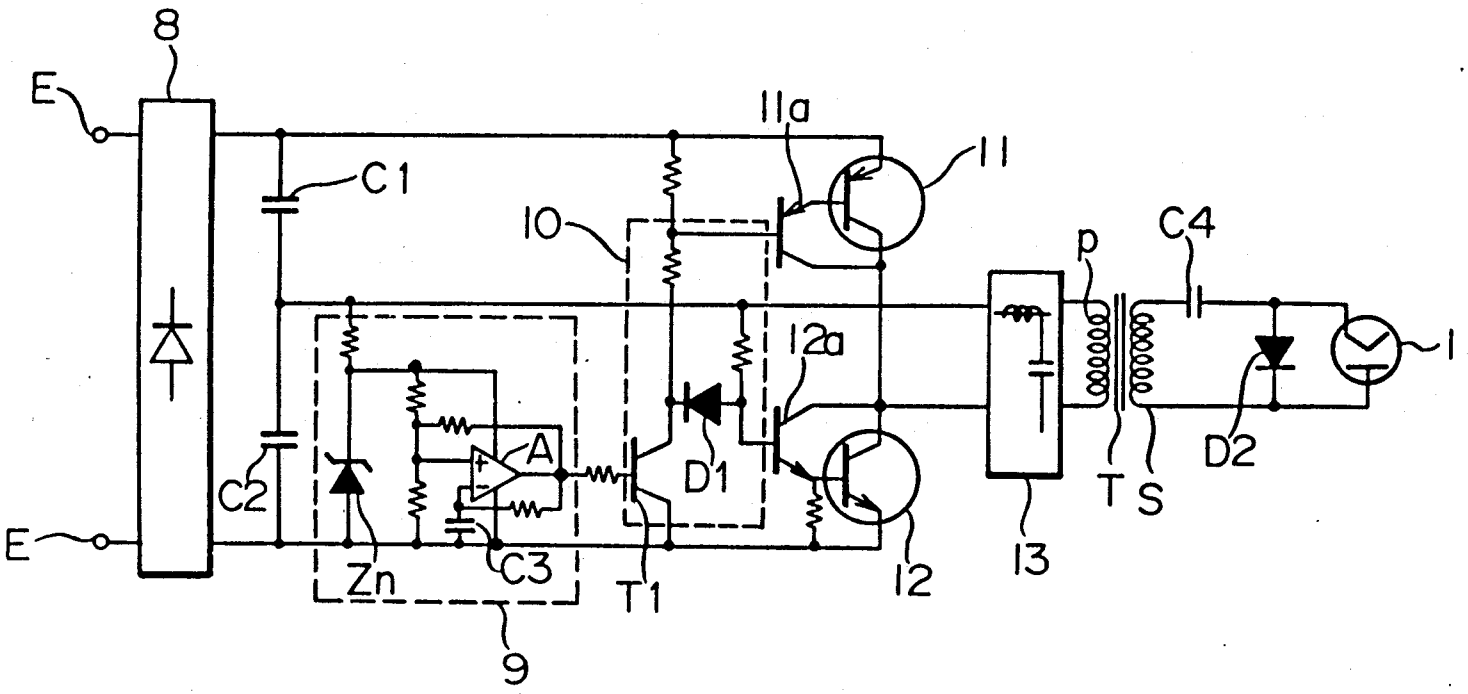
FIGS. 2*a* and 2*b* are diagrams showing conventional power supply circuits for a magnetron, which may be installed to supply microwave energy to an apparatus shown in FIG. 1*a* or 1*b;*
Figure 2B:
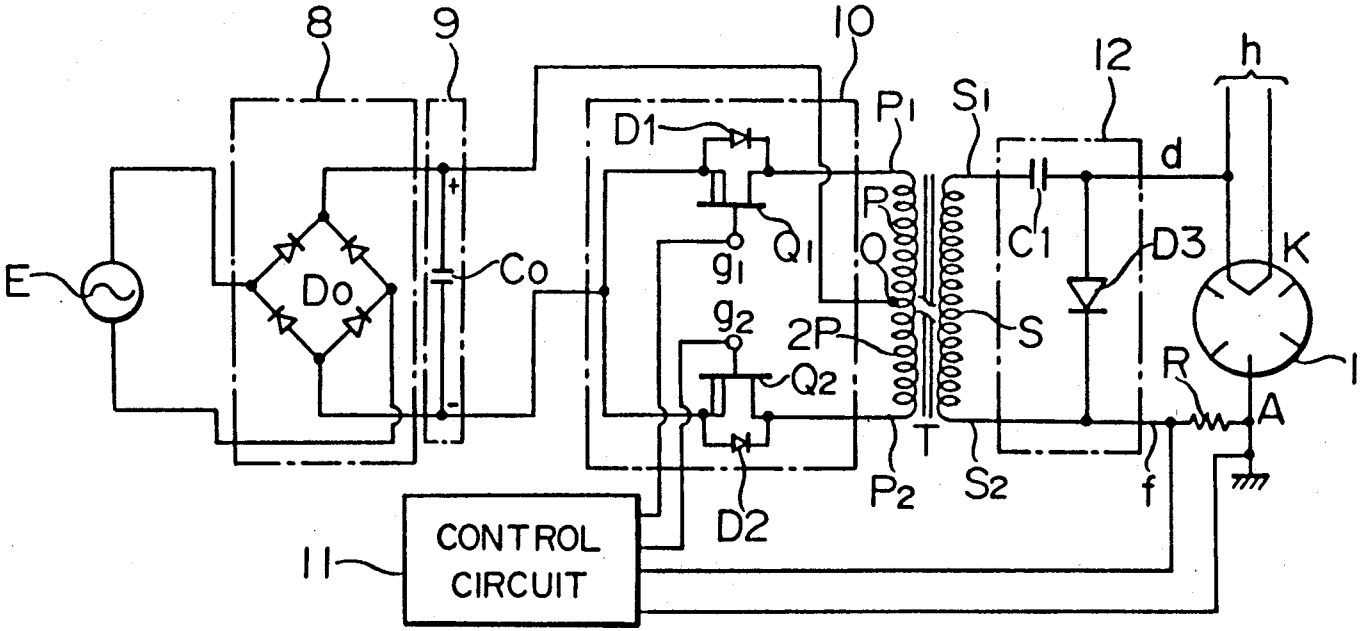

In the succeeding half-cycle Tn, the circuit of FIG. 12 operates as follows. When the gate pulse signals Vgl and Vg4 are outputted by the control circuit 8, the MOSFETs Q1 and Q4 are turned on. Thus, the current $i_l$ flows in the primary winding P in the direction shown by the arrow in FIG. 12; the polarities of the induced current $i_S$ and voltage Vs are reversed with respect to those of the preceding half-cycle Tp, as shown in FIG. 13 (*c*) and (*d*). Thus, the output voltage of the rectifier circuit 5 rises to the sum of the induced voltage Vs in the secondary winding S and the voltage to which the capacitor C5 thereof is charged in the preceding cycle Tp; this output voltage of the rectifier circuit 5 is applied across the capacitor C6, which is already charged in the polarity shown in FIG. 12 in preceding half-cycles Tn. Thus, the voltage $V_{Mg}$ across the magnetron 1, which is substantially equal to the voltage developed across the capacitor C6, has a waveform shown in a solid curve in FIG. 13 (*e*); the maximum voltage level Vmax of the magnetron voltage $V_{Mg}$ is attained near the end of the time period $T_{ON}$. (The waveform of the magnetron voltage $V_{Mg}$ in the conventional circuit according to FIG. 2*b* is shown in a dotted curve therein for comparison's sake; the maximum voltage thereof is indicated by V'max.) When the magnetron voltage $V_{Mg}$ rises above the operating or cut-off voltage Vz, the magnetron current $i_{Mg}$ begins to flow through the magnetron 1, and is maintained during the time in which the voltage $V_{Mg}$ is above the operating voltage level Vz, as shown in a solid curve in FIG. 13(*f*). The mean magnetron current $i_o$ shown therein substantially corresponds to the means output power Po of the magnetron output power $P_{OUT}$, as the increase $V = V\max - Vz$ in the magnetron voltage $V_{Mg}$ above operating voltage level Vz is small compared with the magnitude of the cut-off voltage Vz. The magnetron current $i_{Mg}$ its maximum $i_{max}$ corresponding to the maximum voltage Vmax of the magnetron voltage $V_{Mg}$. (The dotted curve in FIG. 13 (*f*) shows the magnetron current having the same mean value $i_o$ in the case of the conventional circuit according to FIG. 2*b*, the maximum value thereof being indicated by $i'_{max}$.)

As shown in solid and dotted waveforms shown in FIG. 13 (*e*) and (*f*), the maximum or peak values Vmax and $i_{max}$ of the magnetron voltage $V_{Mg}$ and the magnetron current $i_{Mg}$ of the circuit of FIG. 12 is reduced compared with those V'max and $i'_{max}$ of the conventional circuit according to FIG. 2*b*; this is primarily due to the presence of the capacitor C6. As the magnetron current waveforms shown in solid and dotted curves in FIG. 13 (*f*) both have the same mean value $i_o$, the ratio $i_{max}/i_o$ of the peak to the mean value of the magnetron current $i_{Mg}$ in the circuit of FIG. 12 according to the present invention shown by the solid curve is equal to 2.8, while that of the magnetron current in the case of the conventional circuit of FIG. 2*b* shown by the dotted curve is equal to 4.2. Thus, in the circuit of FIG. 12, the ratio $i_{max}/i_o$ $i_o$, and, therefore, the high frequency components of the magnetron current $i_{Mg}$ are greatly reduced compared with those taking place in conventional power supply circuits for a magnetron.

Figure 14:
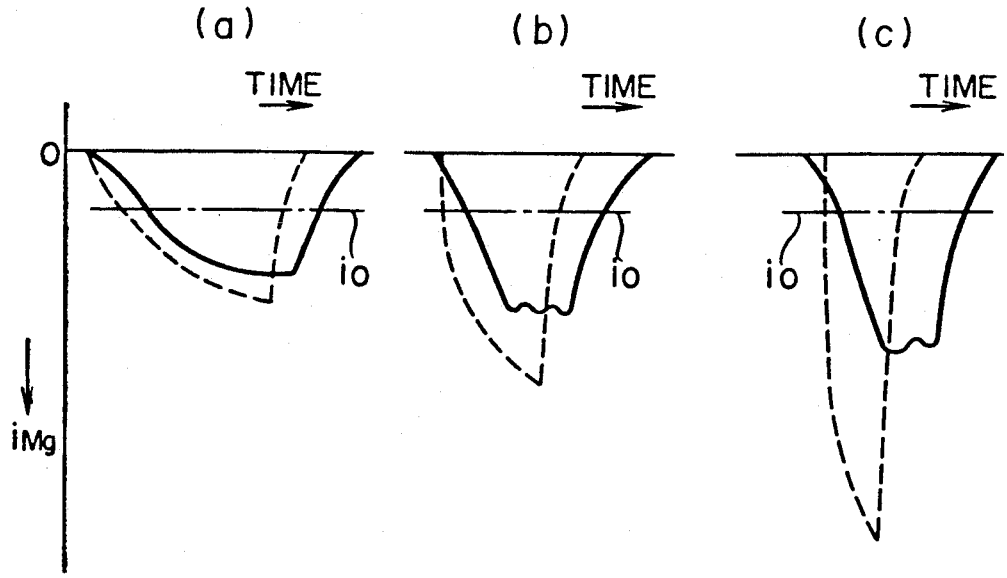
FIG. 14 shows waveforms of magnetron currents in the circuit of FIG. 12.

FIG. 14 shows further illustrative examples showing the reduction of the ratio of the peak to the mean value of the magnetron current in the circuit of FIG. 12 according to the present invention. Namely, the solid and the dotted curves in FIGS. 14 (*a*) through (*c*) show the waveforms of the magnetron current having the same mean value $i_o$; the cases of the circuit of FIG. 12 are shown in solid curves; those of the conventional circuit of FIG. 2*b* are shown in dotted curves. The curves in FIG. 14 (*a*) correspond to the case where the commercial AC line voltage E is 10% under the rate level; those in (b) to the case where the voltage E is at the rate level; those in (c) to the case where the voltage E is 10% above the rate level. The pulse width $T_{ON}$ has been modulated to keep the mean value of the magnetron currents $i_{Mg}$ shown in FIGS. 14 (*a*) through (*c*) at the same level $i_o$. The ratio $i_{max}/i_o$ of the peak to the mean value of the magnetron current $i_{Mg}$ in the case of the embodiment according to the present invention shown in solid curves in FIG. 14 is equal to: 2.0 where the voltage E is 10% under the rate level, as shown in (a); 2.86 where the voltage E is at the rated level, as shown in (b); 2.4 where the voltage E is 10% above the rated level, as shown in (c). On the other hand, the same ratio $i_{max}/i_o$ in the case of the conventional circuit according to FIG. 2*b* is equal to 2.6, 4.2, and 7.0, when the voltage E is 10% under, equal to, and 10% above the rated level, respectively, as shown in dotted curves in FIGS. 14 (*a*) through (*c*), respectively.

When the ratio $i_{max}/i_o$ of the peak to the mean magnetron current becomes greater than 3.75, namely, if $$i_{max}/i_o > 3.75 \ldots \quad (9)$$

flickerings are observed in the discharge in the electrodeless discharge bulb which is caused by the microwave generated by such magnetron current. Thus, in the case shown in FIG. 13 (*f*), the magnetron current shown in solid curve according to the present invention causes no flickering in the discharge in the electrodeless bulb; the magnetron current in the case of the conventional circuit shown in dotted curve, however, causes flickering in the discharge therein. Similarly, the magnetron currents shown in solid curves in FIGS. 14 (*a*) through (*c*) according to the present invention cause no flickering in the discharge; those in dotted curves of the conventional circuit shown in FIG. 14 (*a*) through (*c*) all cause flickering; that shown in (c) causes intense flickering in the discharge.

Figure 15:
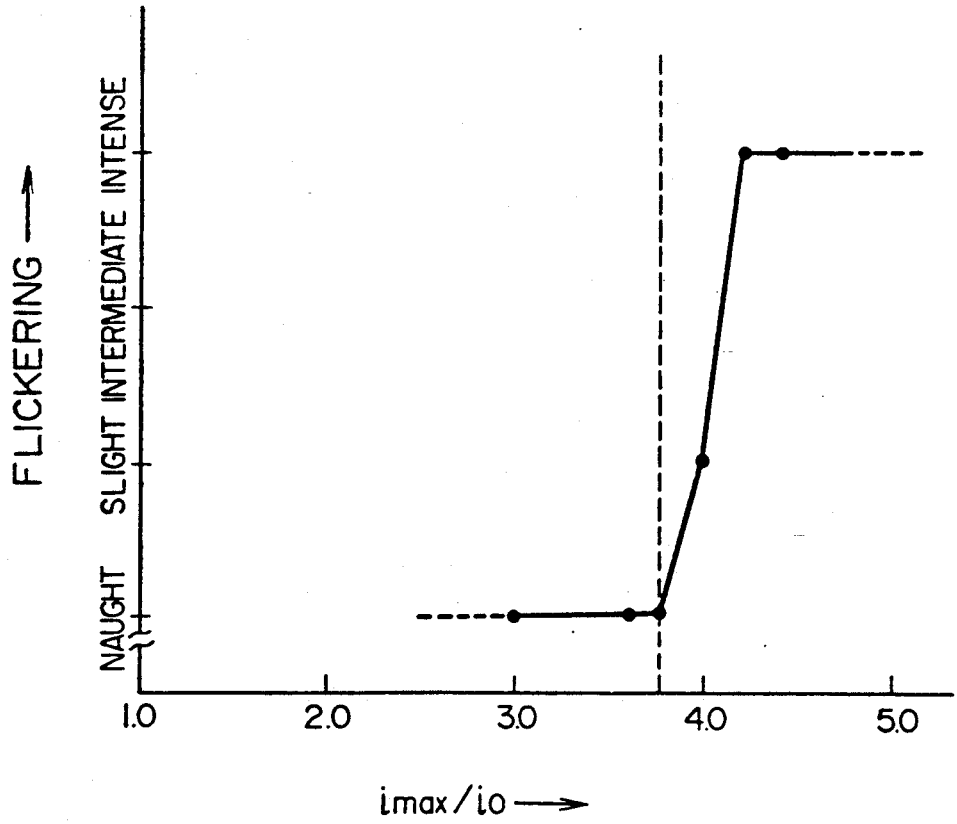
FIG. 15 shows the relationship between the peak to the mean value ratio of the magnetron current and the intensity of flickering observed in the discharge in the electrodeless discharge bulb.

FIG. 15 shows a result of an experiment which shows the critical meaning of inequality (9) above. Namely the curve of FIG. 15 shows the change observed in the intensity of flickering in the arc of the discharge in the electrodeless bulb, with respect to the peak to the mean magnetron current ratio $i_{max}/i_o$, plotted along the abscissa, wherein the inverter switching frequency f has been set at 100 kHz, and the mean microwave output power at 850W in the circuit according to FIG. 12. From the experimental result shown in FIG. 15, it can be concluded that no flickering occurs if the ratio $i_{max}/i_o$ is not greater than 3.75, namely, if $$i_{max}/i_o \leqq 3.75; \ldots \quad (10)$$

and that the intensity of flickering increases abruptly when the ratio $i_{max}/i_o$ exceeds 3.75, the flickering becoming intense when the ratio $i_{max}/i_o$ reaches 4.2.

Figure 16:
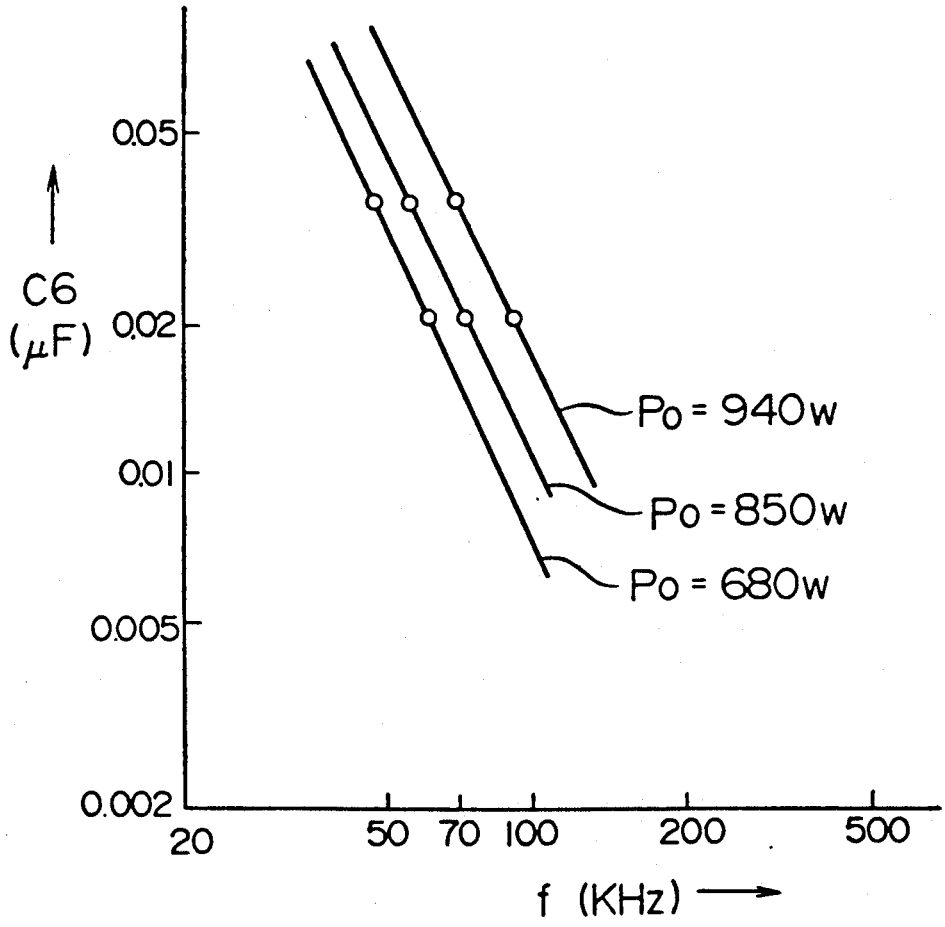
FIG. 16 shows the relationships between the inverter switching frequency and the capacitance coupled across the magnetron which is effective in suppressing the occurrence of flickering in the discharge in the electrodeless bulb.

As described above, the existance of the capacitance of the capacitor C6 in the circuit of FIG. 12 is effective to reduce this peak to mean ratio $i_{max}/i_o$ of the magnetron current $i_{Mg}$. FIG. 16 shows the relationships of the frequency f (plotted along the abscissa in kHz) and the capacity of the capacitor C6 (plotted along the ordinate in microfarads) which is effective in suppressing the occurrence of flickering in the discharge, i.e, in reducing the ratio $i_{max}/i_o$ to a level satisfying inequality (10) above; the three curves correspond to the cases in which the mean magnetron output power Po is equal to 680W, 850W, and 940W, respectively. The results shown in FIG. 16 were obtained by an experiment in which the circuit according to FIG. 12 was used to supply microwave to a spherical electrodeless discharge bulb 30 mm across, in which sodium iodide, mercury, and argon were encapsulated.

While description was made of particular embodiments according to the present invention, it will be understood that many modifications may be made without departing from the spirit thereof; the appended claims are contemplated to cover any such modifications which fall within the true spirit and scope of the present invention. For example, the inverter switching circuit may be constituted by a half bridge circuit or monolithic forward circuit instead of full bridge circuit or push-pull circuit. Further, the switching circuit may comprise, instead of the MOSFETs utilized in the embodiments described above, power transistors SIT or GTO, SI thyristors, or magnetic amplifiers. Further still, the inductance L in the first and the second embodiment may be constituted by a leakage inductance of the step-up transformer, i.e., the self-inductances of the primary and the secondary winding thereof. In the case of the fifth embodiment, instead of the capacitor C6, an inductance may be inserted in series with the magnetron to suppress the high frequency components in the magnetron current; alternatively, a combination of an inductance and a capacitance may be used for the same purpose.

We claim:

1. A circuit system adapted to supply microwave energy to a microwave discharge light source apparatus including an electrodeless discharge bulb, comprising:

first rectifier means, adapted to be coupled to an AC voltage source of a relatively low voltage and frequency, for outputting a rectified voltage of a relatively low voltage;

filter means, coupled to said first rectifier means, for smoothing said rectified voltage outputted from said first rectifier means, and for outputting a smoother rectified voltage;

inverter means, coupled to said filter means, for converting said smoothed rectified voltage outputted from said filter means to an AC voltage of a relatively high frequency having a waveform of alternating pulses, wherein the relative high frequency f, expressed in kilohertz, of the AC voltage outputted by said inverter means is not less than 1500 divided by a diameter D, expressed in millimeters, of said electrodeless discharge bulb of the microwave light source apparatus:

$$f \leqq 1500/D;$$

pulse width modulation control means for modulating a pulse width of said pulses of said AC voltage outputted from said inverter means;

a step-up transformer having a primary winding coupled to an output of said inverter means, a secondary winding of the step-up transformer outputting an AC voltage of said relative high frequency and of a relatively high voltage;

second rectifier means, coupled to said secondary winding of said step-up transformer, for rectifying said AC voltage of the relative high frequency and the relative high voltage outputted from said secondary winding to a rectified voltage of a relatively high voltage; and a magnetron coupled to said second rectifier means, to be supplied with and operated by said rectified voltage of the relative high voltage outputted from said second rectifier means.

2. A circuit system as claimed in claim 1, further comprising inductance means, operatively coupled to said step-up transformer, for suppressing a rapid change in a level of a current flowing through a winding of said step-up transformer.

3. A circuit system as claimed in claim 1, wherein said inverter means comprises a switching circuit including four transistors electrically connected in full bridge circuit relationship.

4. A circuit system as claimed in claim 1, wherein said inverter means comprises a switching circuit including a pair of transistors electrically connected in push-pull circuit relationship.

5. A circuit system as claimed in claim 2, wherein said inductance means comprises an inductance electrically connected in series with said primary winding of said step-up transformer.

6. A circuit system as claimed in claim 2, wherein said inductance means comprises an inductance electrically connected in series with sad secondary winding of said step-up transformer.

7. A circuit system as claimed in 2, wherein said inductance means comprises a leakage inductance of said transformer.

8. A circuit system as claimed in claim 2, wherein said primary winding of said step-up transformer comprises a first and a second winding position, and said inductance means comprises a mutual inductance electrically connected between said first and second winding portion of said primary winding in series circuit relationship.

9. A circuit system as claimed in claim 1, wherein said pulse width modulation control means comprises current detector means for detecting a current level of a current flowing through said magnetron, and means for varying said pulse width of said AC voltage outputted by said inverter means in response to said current level of the current flowing through the magnetron detected by said detector means, thereby maintaining an output power of the magnetron at a predetermined level.

10. A circuit system as claimed in claim 9, wherein said predetermined level is variable.

11. A circuit system as claimed in claim 1, wherein said first rectifier means comprises four diodes electrically connected in bridge circuit relationship.

12. A circuit system as claimed in claim 1, wherein said filter means comprises a capacitor electrically connected across output terminals of said first rectifier means.

13. A circuit system as claimed in claim 1, wherein said second rectifier means comprises a diode and a capacitor electrically connected in series coupled across terminals of said secondary winding of the step-up transformer.

* * * * *